US008777350B2

(12) United States Patent
Miura

(10) Patent No.: US 8,777,350 B2
(45) Date of Patent: Jul. 15, 2014

(54) RECORDING APPARATUS USING A FIRST RECORDING PROCESS AND A SECOND RECORDING PROCESS

(75) Inventor: Hirotsuna Miura, Fujimi (JP)

(73) Assignee: Seiko Epson Corporation, Tokyo (JP)

( * ) Notice: Subject to any disclaimer, the term of this patent is extended or adjusted under 35 U.S.C. 154(b) by 254 days.

(21) Appl. No.: 13/349,697

(22) Filed: Jan. 13, 2012

(65) Prior Publication Data

US 2012/0182341 A1 Jul. 19, 2012

(30) Foreign Application Priority Data

Jan. 18, 2011 (JP) ..... 2011-007908

(51) Int. Cl.
*B41J 29/38* (2006.01)

(52) U.S. Cl.
USPC ..... 347/12

(58) Field of Classification Search
None
See application file for complete search history.

(56) References Cited

U.S. PATENT DOCUMENTS 6,164,745 A * 12/2000 Nagoshi et al. ..... 347/15
6,302,517 B1 * 10/2001 Kanaya ..... 347/41
6,312,081 B1 11/2001 Ohtsu

FOREIGN PATENT DOCUMENTS

JP 2000-229425 8/2000
JP 2010-253699 11/2010

* cited by examiner

*Primary Examiner* — Geoffrey Mruk
*Assistant Examiner* — Bradley Thies
(74) *Attorney, Agent, or Firm* — Workman Nydegger

(57) ABSTRACT

A print area is a print target region by a recording unit on a sheet (recording medium). First, in first lateral scanning, raster lines (white beads) of a base image are printed by moving a recording unit in a main scanning direction by using nozzles arranged in a sub-scanning direction and printing of total M passes is performed while shifting the recording unit for each pass in the main scanning direction and the sub-scanning direction.

4 Claims, 12 Drawing Sheets

THE LARGES RECORDING LENGTH $\Delta L = L/N$ (N: PLATE NUMBER)
MAIN SCANNING-FEEDING AMOUNT $\Delta x = \Delta L/M$ (M: PASS NUMBER)
SUB-SCANNING-FEEDING AMOUNT $\Delta y = 2\Delta p/M$ ($\Delta p$: NOZZLE PITCH)

FIRST LATERAL SCAN

SECOND LATERAL SCAN

THIRD LATERAL SCAN

FOURTH LATERAL SCAN

RECORDING APPARATUS USING A FIRST RECORDING PROCESS AND A SECOND RECORDING PROCESS

This application claims the benefit of Japanese Application No. 2011-007908, filed Jan. 18, 2011, all of which is hereby incorporated by reference.

BACKGROUND

1. Technical Field

The present invention relates to a recording method of performing recording on a recording medium by operating a recording unit, such as a recording head, for scanning, such as a lateral type recording method or a serial type recording method, and a recording apparatus.

2. Related Art

For example, a printing apparatus (recording apparatus), such as a lateral scan type printer or a serial type printer, prints a document or an image on a recording medium (target) by spraying ink droplets from the nozzles of a recording head disposed on a carriage during each of movement while moving the carriage several times (several passes) in the main scanning direction. A nozzle line, in which a plurality of nozzles (for example, 180 or 360) is arranged at regular pitches in a sub-scanning direction crossing the main scanning direction, is formed for each color on a nozzle-forming surface opposite to the target of the recording head.

The gap of dot lines (raster lines) in the sub-scanning direction, which are drawn by the nozzles in lines in the main scanning direction when the carriage performs main scanning, depends on the variation in the nozzle pitch. For example, in band printing that performs printing by using all of nozzles, the variation in the pitch of the nozzles is reflected as the variation in the gaps of the raster lines, such that banding (concentration non-uniformity), such as white stripes extending in the main scanning direction, is generated on a printed image, which causes reduction in print quality. This is because the nozzles used for drawing adjacent raster lines are always the same adjacent nozzles. Therefore, an interlaced recording method (microweave recording method) that selects nozzles that are not adjacent to each other and used for drawing adjacent raster line may be employed particularly in a print mode for printing a high-quality print image.

A print image is formed in the interlaced recording method by drawing a plurality of raster lines in first main scanning (pass) of a carriage with a predetermined number of nozzles in the sub-scanning direction as used nozzles in all of nozzles in a nozzle line, moving the carriage to the next pass position in the sub-scanning direction, drawing raster lines to fill the gaps between the previous pixel lines by using the used nozzles in the next pass, and gradually filling the gaps with raster lines by repeating this operation several times.

For example, JP-A-2010-253699 discloses a technology of acquiring a correction value for correcting a gradation value of a line region corresponding to a nozzle on the basis of a read-out gradation value, which is acquired by printing a correction pattern and reading out the pattern with a scanner, in order to reduce banding.

However, when images for a label are continuously printed on a long recording medium, such as rolled paper in the lateral scan type, a carriage (recording head) performs main scanning in the transport direction of the recording medium, such that printing is performed by a predetermined length in the longitudinal direction of the recording medium. Therefore, the boundary between the previous printing and the next printing of the recording head may be generated in one image. In this case, there is a problem in that banding, such as a white stripe extending in the sub-scanning direction, occurs around the boundary of the previous printing and the next printing in the image. The technology disclosed in JP-A-2010-253699 initially sets a correction value for correcting a gradation value in a printing apparatus during product shipping or the like, such that it is difficult to remove banding that extends in the sub-scanning direction and may occur at the boundary of the previous printing and the present printing even by using the technology of JP-A-2010-253699.

Further, when printing is performed on a transparent recording medium, such as a transparent film, a double-plate printing, which prints (basic printing) a base plate image (for example, beta print image) with a basic color (for example, white) ink and then printing a plate of a main image over the basic plate image (main printing), is performed. In this case, since the basic ink is difficult to dry, the ink for main printing performed over the half-dried basic print image soaks, such that the print quality is deteriorated. In order to solve the problem, for example, it is possible to consider a recording method that performs basic printing on the upstream half of a print area and performs main printing on the downstream half in main scanning, transporting a recording medium by half the length of the print area in the main scanning direction each time one lateral scanning is finished by finishing main scanning a predetermined number of times in the interlaced recording method, and thereafter alternately repeating these operations. According to this recording method, only the time in which the time interval from the previous basic printing to the present main printing is the same as the time taken for one lateral scanning is ensured. Therefore, it is possible to avoid deterioration of print quality due to main scanning being performed after basic printing with dried ink and the ink for the main printing soaks. However, banding that extends in the sub-scanning direction due to boundaries in a print image occurs in the recording method, when the boundary between the previous basic printing and the present basic printing and a boundary between the previous main printing and the present main printing are in the image range.

On the other hand, a time interval for avoiding the soaking is disclosed, for example, in JP-A-2000-229425, in which the time T (ms) that is necessary until ink droplets completely permeate the recording medium is expressed by $T=(4V/\pi D^2Ka)^2$. In the expression, V is the maximum amount of ink droplets (ml) discharged from an ink jet head by one operation, D is an average equivalent circle diameter (m) of the dots when the ink droplets are landed on the recording medium, and Ka is an absorption coefficient ($ml/m^2 \cdot ms^{1/2}$) for ink to permeate the recording medium. In JP-A-2000-229425, when the time until the next ink droplets are landed on the same position after ink droplets are landed on a recoding medium is Tx (ms), the conditions of T, V, D, and Ka are set to satisfy $T \leq Tx$, that is, $(4V/\pi D^2Ka)^2 \leq Tx$. However, when the type of ink, the material of the recording medium, the maximum amount of ink droplets, or the average equivalent circle diameter D of the dots is usually determined in advance by a user and V, D, and Ka are hardly be changed in this case, such that it is necessary to ensure a time interval equal to or more than the time $T=(4V/\pi D^2Ka)^2$ that is determined from V, D, Ka according to the type of ink or the material of the recording medium. In particular, since it is difficult to dry or cure ink containing aqueous resin (aqueous resin ink) in comparison to ECO-SOL ink (a kind of organic solvent ink) or ultraviolet-curable ink (UV ink), it is necessary to lengthen the time after ink droplets are landed on the recording medium until the next ink droplets are landed on the same position.

An advantage of some aspects of the invention is to provide a recording method and a recording apparatus that can reduce banding (concentration non-uniformity) that extends in a sub-scanning direction in a recording method of moving a recording unit for scanning.

SUMMARY

According to an aspect of the invention, there is provided a recording method using a recording unit that includes a nozzle line having a plurality of nozzles and performs recording on a recording medium by ejecting liquid from the nozzle while moving in a first direction crossing the direction of the nozzle line, and a relative moving unit that relatively moves the recording unit and the recording medium in a second direction crossing the first direction, in which the method includes: a first recording process that records dot lines, with a plurality of row recording regions set at a position shifted in the main scanning direction and a sub-scanning direction as a recording target region, on the recording medium, by alternately performing main scanning that records dot lines in which dots are aligned in a row direction that is parallel with a main scanning direction with respect to one nozzle by ejecting liquid from the nozzles while the recording unit is moved and sub-scanning that relatively moves the recording unit and the recording medium in the second direction; and a second recording process that records dot lines in the present row recording region adjacent in the same line to the previous row recording region where the dot lines are recorded in the first process by alternately performing the main scanning and the sub-scanning, and the second recording apparatus is then repeated, with the present row recording region of the previous second recording process as the previous row recording region.

According to the aspect of the invention, dot lines are recorded, with a plurality of row recording regions set at a position deviated in the main scanning direction and a sub-scanning direction as a recording target region, by alternately performing main scanning that records dot lines by using the nozzles while the recording unit moves and sub-scanning that relatively moves a recording unit and a recording medium in a second direction. That is, the row recording regions of other rows where dot lines are recorded for each main scanning are disposed with a deviation in the main scanning direction (row direction), such that dot lines of the other rows recorded for each main scanning are disposed with a deviation in the main scanning direction (row direction). Further, in the next second recording process, the next dot lines are recorded in row recording regions adjacent, in the same row, to the row recording regions where the previous dot lines are recorded. Further, thereafter, the second recording process is repeated, with the present row recording region in the previous second recording process as the previous row recording region. Therefore, since the boundary of the previous and present row recording regions in the same row is at different positions in the main scanning direction for each row, the boundary of the dot lines which are recorded in the row recording regions is shown at different positions in the main scanning direction at each time (for example, previous and present times) between lines. As a result, banding that extends in the sub-scanning direction is difficult to be generated.

In the recording method, the first recording process may record dot lines, with a plurality of row recording regions set at a position deviated in the main scanning direction and a sub-scanning direction as a recording target region, on the recording medium, by using an interlaced recording method that records dot lines to fill line spaces of the dot lines recorded by the previous main scanning, by alternately performing, a predetermined times, main scanning that records dots by using at least some nozzles of the nozzle line while the recording unit is moved, and sub-scanning that relatively moves the recording unit and the recording medium in the second direction.

According to the aspect of the invention, in the next main scanning, dot lines are recorded to fill a gap between the dot lines recorded in the previous main scanning, by alternately performing, a predetermined times, main scanning, which records dot lines by using at least some nozzles of the nozzle line while the recording unit is moved, and sub-scanning, which relatively moves the recording unit and the recording medium in the second direction. That is, recording is performed in the interlaced recording method. Therefore, banding that extends in the main scanning direction between the positions due to the difference of the nozzles of the recording unit in the sub-scanning direction is difficult to be generated. Further, dot lines are recorded in a plurality of row recording regions set at positions deviated from the main scanning direction and the sub-scanning direction, on the recording medium. Therefore, for example, dot lines are recorded to fill the row recording regions, the boundary of the previous and the present dot lines in the same row is shown at different positions between lines in the main scanning direction, such that banding that extends in the sub-scanning direction is difficult to be generated. Therefore, banding that extends in the main scanning direction and banding that extends in the sub-scanning direction are difficult to be generated.

In the recording method, the recording method may be a lateral scanning recording method that performs recording by performing lateral scanning in which the recording unit returns to a first main scanning position every time the recording unit finishes M main scannings by alternately performing the main scanning and the sub-scanning while the recording medium is transported in a transport direction that is in parallel with the first direction, the first and second recording processes may include a recording process that records dot lines in the present row recording region by performing main scanning of the recording unit and a scanning position changing process that moves the recording unit in the second direction for sub-scanning so as to be disposed at the next main scanning position while transporting the recording medium in the transport direction as much as a length corresponding to 1/M of the maximum recording length of one main scanning, and the recording unit may be returned to the first main scanning position every time the M main scannings is finished, by alternately performing the recording process and the scanning position changing process.

According to the aspect of the invention, dot lines are recorded in the present row recording region by performing one main scanning in a recording process and a scanning position changing process is performed after the one main scanning. In the main scanning position changing process, the recording medium is transported in the transport direction that is parallel with the first direction in a length corresponding to 1/M of the maximum recording length of one main scanning and the recording unit is moved for sub-scanning in the second direction and disposed at the next main scanning position. Further, the recording unit is returned to the first main scanning position every time M main scannings are finished. Thereafter, similarly, recording of dot lines in the present row recording region by the main scanning in the recording process, sub-scanning of the recording unit in the main scanning position changing process, and transporting of the recording medium are alternately performed, the recording unit is repeatedly returned to the first main scanning position every time M main scannings (recording processes) are finished. As the recording medium is transported by the length corresponding to 1/M of the maximum recording length of one main scanning, every time dot lines are recorded in a row recording region by one main scanning, the row recording region is deviated opposite the transport direction and dot lines are recorded in the row recording region deviated in the transport direction (main scanning direction), such that the boundary of the dot lines is shown at different positions in the main scanning direction at each time (for example, previous and present times) between lines. As a result, banding that extends in the sub-scanning direction is difficult to be generated.

In the recording method, the recording unit may perform N-plate recording that records N (N is a natural number of 2 or more) plate images to overlap each other on the recording medium, the row recording region in the first and second recording process may be set to the same length as the length in the main scanning direction of division regions acquired by dividing the maximum recording region, where recording is performed by one main scanning of the recording unit, into N in the first direction, the first and second recording processes may include a recording process that records dot lines in the present row recording region by performing main scanning of the recording unit and a scanning position changing process that moves the recording unit in the second direction for sub-scanning so as to be disposed at the next main scanning position while transporting the recording medium in the transport direction as much as a length corresponding to 1/M of the length in the main scanning direction of the division regions, after one scanning, when the N division regions are a first division region, . . . , an N-th division region, sequentially from the upstream side in the transport direction, the first recording process may be a recording process that records dot lines of a first plate image in a row recording region in one division region in the N division regions during M main scannings by alternately performing the recording process and the scanning position changing process in the N-th and the following lateral scanning, and that records a first plate image to an N-th plate image by recording dot lines of an i+1-th plate image over the i-th plate image, which is recorded in the previous lateral scanning, in a row recording region in an i+1-th division region, when i is 1, . . . , N−1, and the second recording process may be a process that records dot lines of a first plate image in the first division region during M main scannings by alternately performing the recording process and the scanning position changing process in the next lateral scanning of the first recording process, and that records a first plate image to an N-th plate image by recording dot lines of an i+1-th plate image over the i-th plate image, which is recorded in the previous lateral scanning, in a row recording region in an i+1-th division region.

According to the aspect of the invention, dot lines are recorded in a row recording region set at the same length as the main scanning direction length of the corresponding division regions in N division regions acquired by dividing the maximum recording region, which is recorded by one scanning of the recording unit, into N in the first direction, in the recording process. After one main scanning, the recording medium is transported by the length corresponding to 1/M of the main scanning direction length of the division regions while the recording unit is moved in the second direction for sub-scanning and disposed at the next scanning position. Further, one lateral scanning is performed by performing M main scannings, by alternately performing a recording process and a scanning position changing process. First, the first recording process is a recording process that records dot lines for a first plate image in a row recording region in the first division region in the N division regions during M main scannings by alternately performing the recording process and the scanning position changing process in the N-th and the following lateral scanning, and records dot lines for the i+1-th plate image over the i-th plate image, which is recorded in the previous lateral scanning, in a row recording region of the i+1-th division region (i=1, . . . , N−1). Therefore, the dot lines of the first plate image to the N-th plate image are recorded over the plate image of the lower layer of the first plate recorded in the previous lateral scanning, in the N division regions in M main scanning in one lateral scanning. For example, in double-plate recording with N=2, dot lines for the first plate image are recorded in a row recording region in the first division region of two division regions in M main scannings and dot lines for the second plate image is recorded over the first plate image recorded in the previous lateral scanning, in a row recording region in the second division region. Further, for example, in triple-plate recording with N=3, dot lines for the first plate image are recorded in a row recording region in the first division region of three division regions in M main scannings, dot lines for the second plate image are recorded over the first plate image recorded in the previous lateral scanning, in a row recording region in the second division region, and dot lines for the third plate image are recorded over the second plate image recorded in the previous lateral scanning, in a row recording region in the third division region.

In the second recording process, dot lines for a first plate image are recorded in the first division region during M main scannings by alternately performing the recording process and the scanning position changing process, and dot lines for an i+1-th plate image are recorded over the i-th plate image, which is recorded in the previous lateral scanning, in a row recording region in the i+1-th division region. Thereafter, dot lines for the first plate image are recorded in the first division region and dot lines for the i+1-th plate image are recorded over the i-th plate image recorded in the previous lateral scanning, in a row recording region in the 1+1-th division region, in main scanning of each lateral scanning. Therefore, the dot lines of the first plate image to the N-th plate image are recorded over the plate image of the lower layer of the first plate recorded in the previous lateral scanning, in the N division regions in M main scanning in the next lateral scanning. Accordingly, it is possible to ensure a time interval until the plate image of an upper layer is recorded on the plate layer of a lower layer, as much as the necessary time of one lateral scanning. Therefore, a drying time is ensured from recording of the plate image of the lower layer to recording of the plate image of the upper layer. As a result, it is possible to record the images of N plates to overlap each other while avoiding permeation of fluid. Therefore, banding that extends in the main scanning direction and the sub-scanning direction is difficult to be generated and the ink of the plate image of the upper layer is difficult to permeate, such that it is possible to perform multi-plate recording with high quality.

In the recording method, recording of the first plate image to the N-th plate image with N different types of fluid for each division region is performed in the N division regions.

According to the aspect of the invention, recording of the first plate image to the N-th plate image with N different types of fluid is performed in a row recording region in division regions, in the N division regions. The plate images are recorded by using appropriate types of fluid according to the functions of the plates, such that it is possible to provide a printed matter with high quality.

In the recording method, the lateral scanning recording method may determine whether a necessary time from finishing of the previous lateral scanning to starting of the present lateral scanning is equal to or more than a set time for drying the portion where recording of a plate image of a lower layer is performed between recording of the plate image of the lower layer and recording of the plate image of the upper layer in the first plate image to the N-th plate image, and when it is determined that the necessary time is not equal to or more than the set time, the necessary time may be made equal to or more than the set time by reducing a movement speed of the recording unit or delaying start of driving by giving a stopping time to the recording unit.

According to the aspect of the invention, it is determined whether a necessary time from finishing of the previous lateral scanning to starting of the present lateral scanning is equal to or more than a set time for drying the portion where recording of a plate image of a lower layer is performed between recording of the plate image of the lower layer and recording of the plate image of the upper layer in the first plate image to the N-th plate image. Further, when it is determined that the necessary time is not equal to or more than the set time, the necessary time is adjusted to be equal to or more than the set time by reducing a movement speed of the recording unit or delaying start of driving by giving a stopping time to the recording unit. Therefore, a necessary drying time from recording of the plate image of the lower layer to recording of the plate image of the upper layer is ensured. Accordingly, recording of the plate image of the upper layer is performed after the portion where the previous printing is performed is dried by a necessary amount, such that it is possible to deterioration of quality of the print image due to permeation of ink caused because the plate image of the upper layer is printed, with the ink of the lower layer insufficiently dried, for example.

In the recording method, the N-plate images performed in the N division regions by one main scanning may be two or more combinations of a base image, a main image, and an overcoat image.

According to the aspect of the invention, when recording of N plates (two plate or three plates) implemented by two or more combination of the plate of a base image, the plate of a main image, and the plate of an overcoat image, banding that extends in both the main scanning direction and the sub-scanning direction is difficult to be generated, such that it is possible to perform recording with high quality by suppressing permeation of ink even in multi-plate printing.

In the recording method, the fluid ejected by the recording unit may include aqueous resin.

According to the aspect of the invention, the recording unit performs recording on a recording medium by ejecting ink (aqueous resin ink) including aqueous resin, as fluid. The aqueous resin ink is difficult to be dried in comparison to organic solution-based ink, such as ECO-SOL ink, or photocurable resin-based ink, such as UV ink, but a standby time (drying time) between recording of the plate of a lower layer and recording of the plate of an upper layer is ensured, such that it is possible to provide a print image with high quality by suppressing permeation of ink, even though the aqueous resin ink is used for recording.

According to another aspect of the invention, there is provided a recording apparatus including: a recording unit that includes a nozzle line having a plurality of nozzles and performs recording on a recording medium by ejecting liquid from the nozzle while moving in a first direction crossing the direction of the nozzle line; a relative moving unit that relatively moves the recording unit and the recording medium in a second direction crossing the first direction; and a control unit that controls the recording unit and the relative moving unit, in which the control unit controls the recording unit and the relative moving unit to perform: a first recording process that records a dot line, with a plurality of row recording regions set at a position deviated in the main scanning direction and a sub-scanning direction as a recording target region, on the recording medium, by alternately performing main scanning that records dot lines in which dots are aligned in a row direction that is parallel with a main scanning direction with respect to one nozzle by ejecting liquid from the nozzles while the recording unit is moved and sub-scanning that relatively moves the recording unit and the recording medium in the second direction; and a second recording process that records a dot line in the present row recording region adjacent in the same line to the previous row recording region where the dot line is recorded in the first process by alternately performing the main scanning and the sub-scanning, and to repeat the second recording apparatus, with the present row recording region of the previous second recording process as the previous row recording region. According to a recording apparatus of an embodiment of the invention, it is possible to achieve the same effects as an invention relating to the recording method.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment specifying the invention into an ink jet type printer using a lateral scan method is described with reference to FIGS. 1 to 12.

Figure 1:
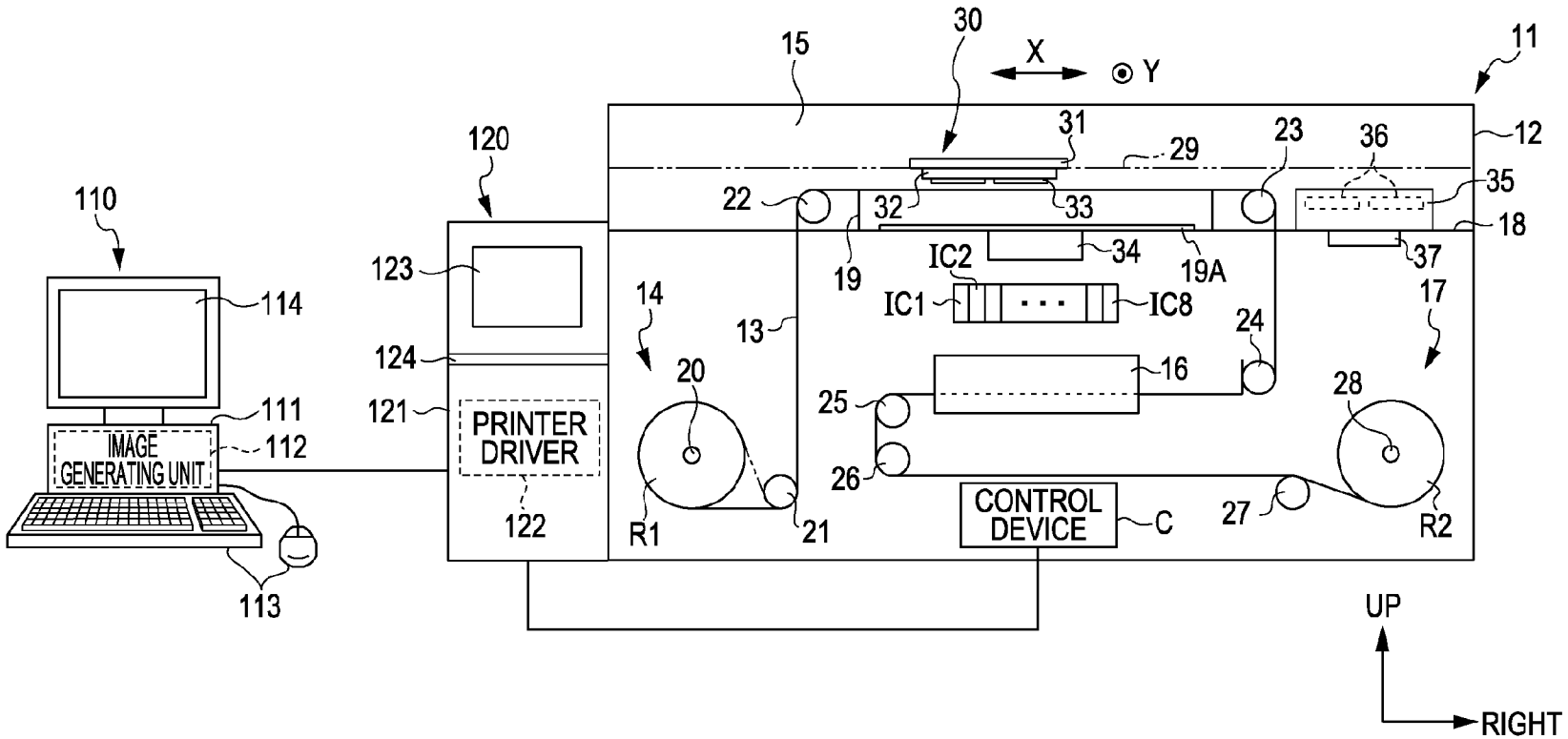
FIG. 1 is a schematic front view of a printing system according to an embodiment substantiating the invention.

As shown in FIG. 1, a printing system 100 includes an image generating device 110 that generates image data, a host device 120 that generates print data on the basis of the image data received from the image generating device 110, and an ink jet type printer (hereafter, simply referred to as a "printer 11") using a lateral scan method, which is an example of a recording apparatus that prints an image on the basis of the print data received from the host device 120.

The image generating device 110 includes an image generating unit 112 that is implemented, for example, by a personal computer in which a CPU in a main body 111 executes programs for creating an image. A user starts the image generating unit 112 and operates an input device 113 to create a print image on a monitor 114. For example, when the product is a label, a plurality of frames is generated with a plurality of label images arranged in a matrix is generated. Further, when a predetermined operation is performed by the input device 113, image data relating to the image is transmitted to the host device 120 through a communication interface. Obviously, it is possible to read the image data into the host device 120 from the image generating device 110 by operating the host device 120.

The image generating device 120 includes a printer driver 122 that is implemented, for example, by a personal computer in which a CPU in a main body 121 executes programs for the printer driver. The printer driver 122 generates print data on the basis of image data and transmits the print data to a control device C disposed in the printer 11. The control device C controls the printer 11 on the basis of the print data received from the printer driver 122 such that the printer 11 prints an image based on the image data. A menu, the image of a print target object or the like is displayed on a monitor 123. It is possible to input and set management information on the product (for example, a label) of a target object and various print conditions on a print set screen that is a lower-rank screen displayed by selection from the menu screen.

The management information includes the product number or lot number of the product and print surface information for designating whether it is front-side printing or rear-side printing in double-sided printing. Further, the print conditions may be the kind and size of print medium, print quality, and the number of printed sheets. There are largely paper-like materials and film-like materials in the kind of print medium. For example, there are high-quality paper, cast paper, art paper, coated paper and the like in the paper-like materials, while there are synthetic paper, PET, and PP in the film-like material. Further, as the size of the print medium, a roll width or the like is set in the printer 11 under the assumption of using a roll of which a long print medium is wound. A variety of print modes determining print resolution or recording types are set in the print quality and one of the print modes is selected. Further, it may be possible to set the print resolution by changing the print modes. Further, the number of sheets (images) is set in the number of plates when several sheet printing is performed, which repeatedly prints a plurality of plates (images) on the same area of a print medium. When the number of plates is two or more, it is possible to designate an image to each of the plates.

Next, the configuration of the printer 11 shown in FIG. 1 is described. Further, in the following description of the specification, the "left-right direction" and the "up-down direction" is described with reference to the arrows in FIG. 1. Further, the front side is the front side and the back side is the rear side in FIG. 1.

As shown in FIG. 1, a discharging unit 14 that repeatedly discharges long sheets 13 from a roll R1, a printing room 15 that performs printing by ejecting ink (liquid) onto the sheet 13, a drying device 16 (drying furnace) that performs a drying process to the sheet 13 with ink sticking by the printing, and a winding unit 17 that winds the sheet 13, which has undergone the drying process, into a roll R2, are disposed in a rectangular main body case 12 of the printer 11.

The region above a flat plate-shaped base 18 vertically dividing the inside of the main body case 12 is the printing room 15 and a rectangular plate-shaped support base 19 that supports a print area of the sheet 13 is disposed and supported on the base 18 on the bottom center position in the printing room 15. Further, the discharging unit 14 is disposed close to the left side, which is the upstream side in the transport direction of the sheet 13, and the winding unit 17 is disposed close to the right side that is the downstream side, in the region under the base 18 in the main body case 12. Further, the drying device 16 is disposed at a slight upper position between the discharging unit 14 and the winding unit 17. Further, a heater 19A that heats the support base 19 to a predetermined temperature (for example, 40 to 60° C.) is disposed on the bottom of the support base 19, such that the printed portion of the sheet 13 is primarily dried on the support base 19. Further, the primarily dried sheet 13 is secondarily dried in the drying device 16.

As shown in FIG. 1, a winding shaft 20 is rotatably disposed at the discharging unit 14 and the roll R1 is supported to be integrally rotated with respect to the winding shaft 20. Further, the sheet 13 is discharged from the roll R1 by rotation of the winding shaft 20. The sheet 13 discharged from the roll R1 is wound around a first roller 21, which is positioned at the right side of the winding shaft 20, and guided upward.

The sheet 13 of which the transport direction is changed upward by the first roller 21 is wound on a second roller 22, which is disposed at the left side of the support base 19 to vertically correspond to the first roller 21, from the left lower portion. Further, the sheet 13 with the transport direction changed to the horizontal right side by being wound on the second roller 22 comes in contact with the upper surface of the support base 19.

Further, a third roller 23 opposite to the second roller 22 at the left side with the support base 19 therebetween is disposed at the right side of the support base 19. The positions of the second roller 22 and the third roller 23 are adjusted such that the tops of the circumferential surfaces are at the same height as the upper surface of the support base 19.

The sheet 13 transported downstream (right) to the upper surface of the support base 19 is wound on the third roller 23 from the right upper portion and the transport direction is changed vertically downward, and then the sheet 13 is horizontally guided between a fourth roller 24 and a fifth roller 25 which are disposed under the support base 19. The sheet 13 passes through the drying device 16 on the transport path between the rollers 24 and 25. Further, the sheet 13 that has undergone the drying process in the drying device 16 is guided to the fifth roller 25, a sixth roller 26, and a seventh roller 27 and transported close to the winding unit 17, and then wound into the roll R2 by rotation of a winding shaft 28 by a driving force of a transporting motor 61 (see FIG. 2).

For example, in double-sided printing, when a sheet 13 of which the front is printed is fully wound on a roll R2, a drawing-out unit 14 is set by a roll R1 for supply for back printing, other than the roll R2. Further, the sheet 13 from the roll R1 is wound on a first roller 21 in the path shown by a two-dot chain line in FIG. 1 such that the back becomes the print surface. Further, it may be possible to employ a configuration of finishing a punching process of a product portion in the printer 11 by disposing a punching machine (not shown) that can punch the product portion (for example, a label) printed on the sheet 13 on the path between the drying device 16 and the winding unit 17.

As shown in FIG. 1, a pair of guide rails 29 (indicated by a two dot chain line in FIG. 1) which extends in the left-right direction is disposed at both sides in the front-rear direction of the support base 19 in the printing room 15. A recording unit 30, an example of a recording section, is guided by the pair or guide rails 29 to be able to reciprocate in the main scanning direction X. The recording unit 30 includes a rectangular carriage 31 and a plurality of recording heads 33 supported on the lower surface of the carriage 31 through a support plate 32. The carriage 31 is supported to be able to reciprocate in the main scanning direction X (left-right direction in FIG. 1) along both guide rails 29 by the operation of a first carriage motor 62 (see FIG. 2). Further, the carriage 31 can also move in the sub-scanning direction Y (front-rear direction perpendicular to the plane of the paper in FIG. 1 by the operation of a second carriage motor 63 (see FIG. 2). Therefore, the recording unit 30 can move in two directions of the main scanning direction X and the sub-scanning direction Y.

The almost entire surface of a predetermined range of the upper surface of the support base 19 is a print region and the sheets 13 are intermittently transported in the print area unit corresponding to the print region. A suction device 34 is disposed under the support base 19. The suction device 34 is driven to apply a negative pressure to several suction holes (not shown) that are formed through the upper surface of the support base 19, such that the sheet 13 is suctioned to the upper surface of the support base 19 by the suction force due to the negative pressure. Further, the print area of the sheet 13, which is disposed on the support base 19, is printed by alternately performing main scanning that ejects ink from the recording head 33 while moving the recording unit 30 in the main scanning direction X and sub-scanning that moves the recording unit 30 in the sub-scanning direction Y to the next main scan position. Further, as the sheet 13 is transported in the transport direction (left-right in FIG. 1), the print position to the sheet 13 is changed in the main scanning direction X. In this process, the negative pressure of the suction device 34 is removed and accordingly the sheet 13 suctioned to the support base 19 is released and then transported.

Further, a maintenance device 35 that performs maintenance of the recording head 33 during non-printing is disposed in a non-print area that is the right end in the printing room 15 in FIG. 1. The maintenance device 35 includes caps 36 and an elevating device 37. The recording head 33 of the recording unit 30 which stands by at the home position during non-printing is capped by the caps 36 lifted by the operation of an elevating device 37, such that an increase in viscosity of the ink in the nozzle is avoided. Further, when it is a predetermined maintenance time, a suction pump (not shown) of the maintenance device 35 that is capped is driven to generate a negative pressure inside the cap 36, such that the ink is forcibly discharged from the nozzle, and cleansing by removing viscous ink increased in the nozzle or bubbles in the ink is performed.

As shown in FIG. 1, a plurality of (for example, eight) ink cartridges IC1 to IC8 receiving different colors of ink is detachably mounted in the main body case 12. The eight ink cartridges IC1 to IC8 receive, for example, black K, cyan C, magenta M, yellow Y, white W, and clear (transparent for overcoat) ink, respectively. Obviously, the kinds (colors) of the ink can be appropriately set, such that it is possible to employ a configuration of monochrome printing with black ink only or a configuration of predetermined three or more colors, other than the eight colors or two colors. Further, it may be possible to employ a configuration equipped with a cartridge storing a moisturizer for maintenance.

The ink cartridges IC1 to IC8 are connected to the recording head 33 through ink supply channels (not shown). The recording heads 33 perform printing on the sheet 13 by ejecting the ink supplied from the ink cartridges IC1 to IC8. Therefore, color printing is possible in the printer 11 of the embodiment. Further, when the print medium is a transparent object, such as a transparent film, "basic printing" that prints a base layer (base image) with white ink on the sheet 13 is performed first and "main printing" that prints a color or monochromic image (main image) over the base layer is performed. Further, an overcoat layer is formed by ejecting clear ink (transparent ink) onto the upper layer of the main image, regardless of whether the sheet 13 is a transparent object or not and "overcoat printing" that gives durability and luster to the print surface is performed.

As described above, in the printer 11, it is possible to perform "single-plate printing" that prints only one plate of a main image, "double-plate printing" that prints two different plate, such as the combination of a main image and an overcoat layer or a base layer and a main image, and "triple-plate printing" that prints three plates of a base layer, a main image, and an overcoat layer. Obviously, it may be possible to employ a configuration that prints a plurality of plates over three plates or prints print layers, which are a plurality of print plates, other than the three layers described above.

Figure 4:
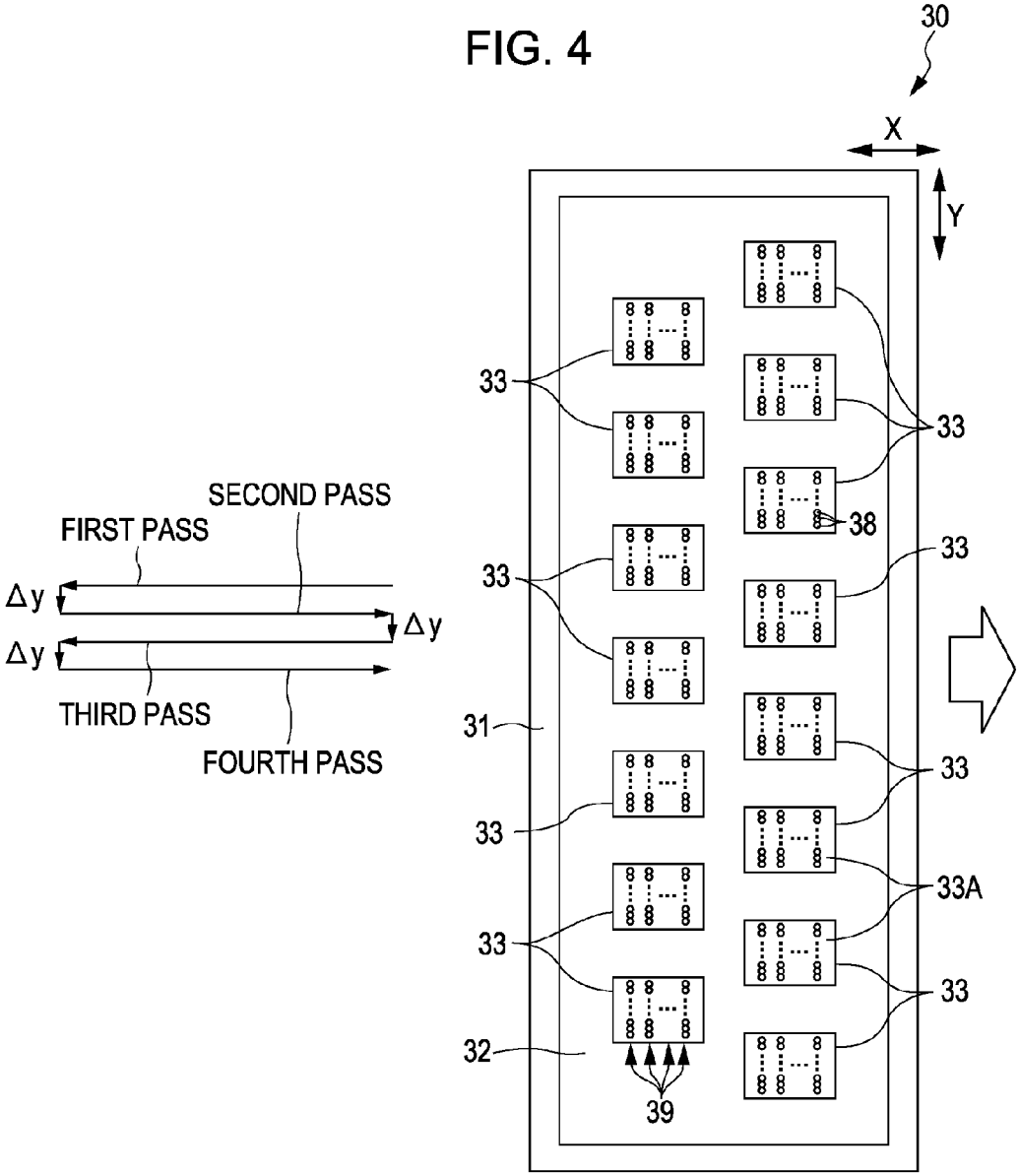
FIG. 4 is a schematic bottom view of a recording unit.

The configuration of the recording heads 33 disposed on the bottom of the recording unit 30 is described with reference to FIG. 4. As shown in FIG. 4, a plurality of (fifteen in the embodiment) recording heads 33 are supported in a zigzag arrangement pattern in the sub-scanning direction Y perpendicular to the transport direction of the sheet 13 (the direction indicated by a white arrow in FIG. 4), on the support plate 32 supported on the bottom (front side in FIG. 4) of the carriage 31. That is, in the fifteen recording heads 33, the recording heads 33 in two lines (seven lines and eight lines in FIG. 4) arranged at a predetermined pitch in the sub-scanning direction Y are alternatively arranged with a half-pitch gap between the lines in the sub-scanning direction Y. Further, a plurality of nozzle lines 39 (eight lines in the embodiment), in which a plurality of (for example, one hundred eighty) nozzles 38 is arranged with a predetermined nozzle pitch in the sub-scanning direction Y, is formed, with a predetermined gap in the main scanning direction X, on the nozzle-forming surface 33A that is the bottom of each of the recording heads 33. Further, the plurality of (eight) nozzle lines 39 receive the ink from one ink cartridge corresponding to each of the eight ink cartridges IC1 to IC8 and eject different kinds of ink. Further, in the embodiment the main scanning direction X crossing the line direction of the nozzle line 39 (nozzle line direction) is a first direction and the sub-scanning direction Y crossing the main scanning direction X (first direction) is a second direction.

First (first frame) lateral scanning that fills all the lines in the sub-scanning direction Y is performed by performing main scanning according to the print resolution a predetermined number of times, by alternately moving the recording unit 30 in the main scan direction X (main scanning) and in the sub-scan direction Y (sub-scanning) in FIG. 4. The first scanning in which the recording unit 30 moves in the main scanning direction X is called a "pass", and, in the embodiment, there are four-pass printing that performs lateral scanning four times and eight-pass printing that performs lateral scanning eight times. FIG. 4 shows an example of four-pass printing, in which the movement path of the recording unit 30 is indicated by an arrow. That is, in the four-pass printing, the first-pass printing is performed first by performing main scanning in which the recording unit 30 is moved one time in the main scan direction X, and when the first-pass printing is finished, the recording unit 30 is disposed at the next main scan start position (next pass start position) by performing insertion of sub-scanning that moves the recording unit 30 as much as the amount of sub-scan transporting Δy in the sub-scanning direction Y. Next, the second-pass printing is performed from the position and the recording unit 30 is disposed at a third-pass main scan start position by performing sub-scanning as much as the amount of sub-scan transporting Δy after the second-pass printing. Thereafter, the third-pass and fourth-pass printing is performed by performing main scanning and sub-scanning in the same way.

When the nozzle pitch is Δp, the amount of sub-scan transporting Δy is set to ½ of the nozzle pitch Δp (=Δp/2) in four-pass printing and ¼ of the nozzle pitch Δp (=Δp/4) in eight-pass printing. Therefore, it is possible to achieve print resolution that is about double that of four-pass printing in eight-pass printing. Obviously, the amount of sub-scan transporting Δy may be set to a predetermined value according to the necessary print resolution.

However, since ink containing water-based resin (referred to "aqueous resin ink") that is relatively difficult to be dried is used in the embodiment such that the nozzle 38 of the recording head 33 is not clogged, the ink is necessary to be thermally heated to the fixed after printing. Since ECO-SOL ink (organic solvent ink) or UV ink (ultraviolet-curable ink) is easily dried or cured in comparison to the aqueous resin ink, additional printing that prints a lower layer (lower plate) and an upper layer (upper plate) to overlap each other with one main scanning may be possible. However, when a plurality of plate printings is performed by using aqueous resin ink that is relatively poor in driability and curability, and when an upper layer (upper plate) is directly performed with the ink of a lower layer (lower plate) insufficiently dried, the ink of the upper layer soaks and the print quality is deteriorated. Therefore, it is difficult to apply a technology of performing additional printing with one main scanning, which employs ECO-SOL ink or UV ink, to the aqueous resin ink. In the embodiment, in first lateral scanning, an upper layer of the present lateral scanning is printed over a lower layer printed by the previous lateral scanning, by printing different plate images on only one layer sequentially from the lower layer (lower plate) from the upstream side in the transport direction in a plurality of division regions divided from a scan region in the main scanning direction. Accordingly, a time interval for drying the ink of the lower layer is provided until the upper layer is printed by the present lateral scanning after the lower layer is printed by the previous lateral scanning.

When the minimum value of the time interval for drying ink is $T_0$, it is preferable to set the time interval to the set time $T_0$ or more. There are the following two methods in the methods of acquiring the necessary time $T_0$. One is a method using a pre-experiment and the other one is a method using a theoretical equation. First, in the former method, a lower layer is printed with white ink on a recording medium, an upper layer is printed over the upper surface with color ink after various time intervals, whether color dots soak is examined, and the shortest time interval that is an allowable permeation range is set to the set time $T_0$.

The later method is a method of setting the shortest time interval for avoiding permeation to the set time $T_0$ on the basis of the theoretical formula disclosed in JP-A-2000-229425. That is, when the time until ink droplets completely permeates a recording medium is the set time $T_0$, the set time $T_0$ is expressed as $T=(4V/\pi D^2Ka)^2$. In the expression, V is the maximum amount of ink droplets (ml) ejected from by one operation from the recording head 33, D is an average equivalent circle diameter (m) of the dots when the ink droplets are landed on the recording medium, and Ka is an absorption coefficient ($ml/m^2+ms^{1/2}$) for ink to permeate the recording medium.

In the embodiment, since the upper layer is printed by the present lateral scanning on the lower layer printed by the previous lateral scanning, the time interval from the printing of the lower layer to the printing of the upper layer, that is, the drying time T1 of the ink of the lower layer is a necessary time for one lateral scanning. Further, the necessary time for one lateral scanning that specifies the drying time T1 is set to the set time $T_0$ or more ($T1 \geq T_0$). For example, the necessary time is set to satisfy $T1 \geq (4V/\pi D^2Ka)^2$, In the embodiment, there are two cases that the pass number M of first lateral scanning, as described above, is 4 (M=4) and 8 (M=8), in accordance with the print resolution. Further, a necessary time for one lateral scanning is set such that the drying time T1 equal to or more than the set time $T_0$ described above is ensured, even for M=4 where the necessary time is the shortest. In detail, at least one of the main scanning movement speed of the recording unit 30, the main scanning movement distance, the sub-scanning movement speed, the sub-scanning movement distance, and the standby time of the recording unit 30 during lateral scanning is adjusted to satisfy the condition of $T1 \geq T_0$. It may be possible to add a predetermined margin time Δt to the set time $T_0$ in order to satisfy the condition of $T1 \geq T_0+\Delta t$.

Next, the electrical configuration of the printing system 100 is described with reference to FIG. 2. A printer driver 122 in a host device 120 shown in FIG. 2 includes a host control unit 125 that controls display of various screens to display on a monitor 123, such as a menu screen and a print set screen, and performs predetermined processes according to operation signals input from an operation unit 124 on the display states of the screens. The host control unit 125 generally controls the printer driver 122.

Further, the printer driver 122 is equipped with a resolution changing unit 126, a color changing unit 127, and a halftone processing unit 128 in order to perform an image process for generating print data for image data received from a higher-rank image generating device 110. The resolution changing unit 126 performs a resolution changing process that changing the display resolution of the image data to the print resolution. The color changing unit 127 performs a color changing process that changes colors from a display color system (for example, an RGB color system or an YCbCr color system) to a print color system (for example, a CMYK color system). Further, the halftone processing unit 128 performs a halftone process that changes in tone the pixel data of high display gradation (for example, 256 gradations) to pixel data of low (for example, two gradations or four gradations) print gradation. Further, the printer driver 122 generates print job data (hereafter, simply referred to as "print data PD") by giving command written by print control codes (for example, ESC/P) to the print image data by applying the image processes.

The host device 120 includes a transmission control unit 129 that controls data transmission. The transmission control unit 129 serially transmits the print data PD by packet data at each time to the printer 11 through a serial communication port U1. Further, the host control unit 125 can bi-directionally communicate with a control device C of the printer 11, such that the host control unit 125 transmits commands or control signals to the printer 11 through the transmission control unit 129 and receives responses from the printer 11.

Figure 2:
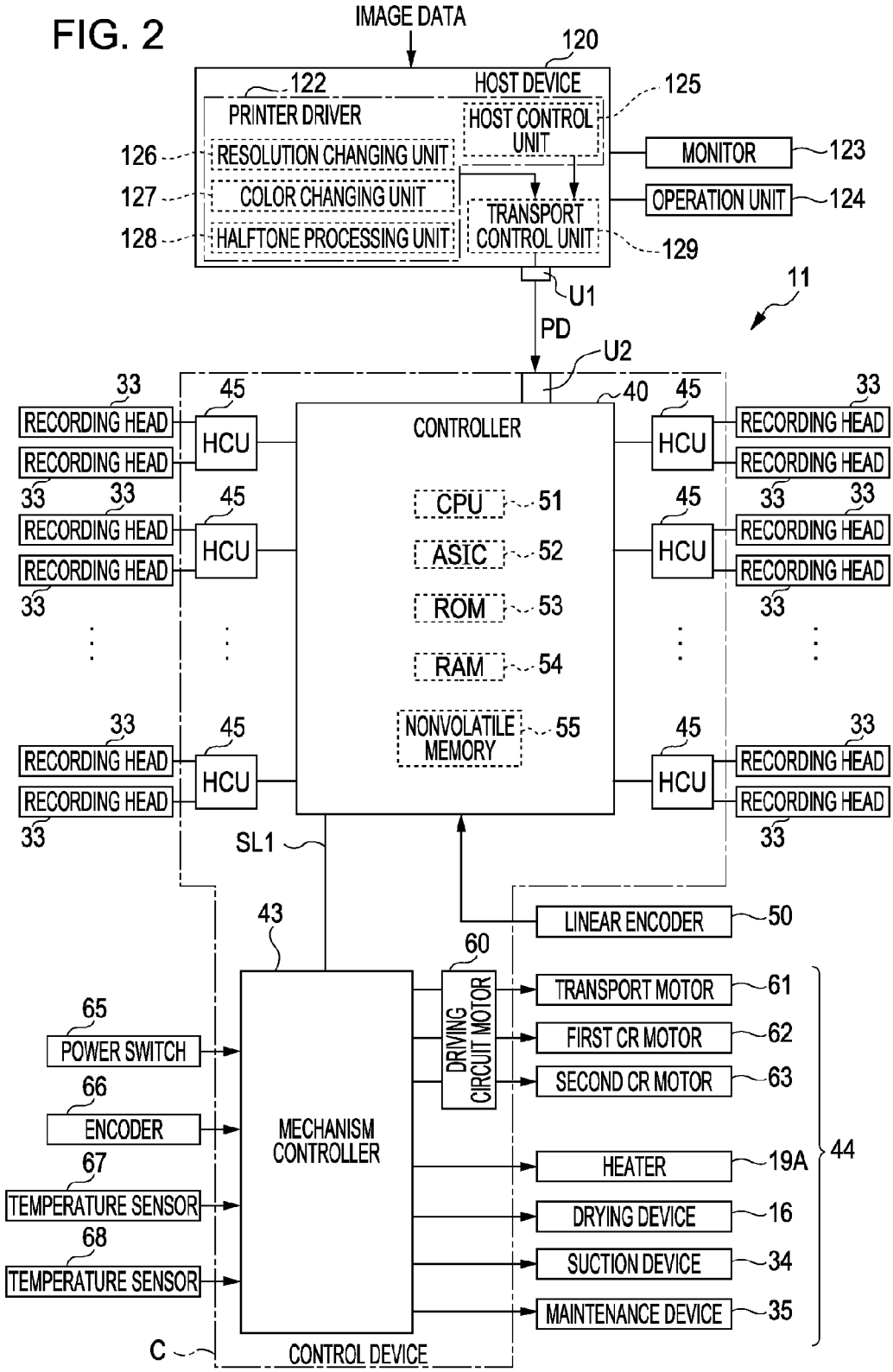
FIG. 2 is a block diagram showing the electrical configuration of the printing system.

The control device C for the printer 11, which is shown in FIG. 2, is equipped with a controller 40 that performs various controls, starting with print control, by receiving the print data PD from the host device 120 through a serial communication port U2. As shown in FIG. 2, a plurality of (fifteen in the embodiment) recording heads 33 is connected to the controller 40 through a plurality of (N (eight in the embodiment) head control units 45 (hereafter, simply referred to as "HCU 45").

As shown in FIG. 2, a linear encoder 50 disposed in the movement path of the carriage 31 (that is, the recording unit 30) is connected to the controller 40. The controller 40 inputs a detection signal (encoder pulse signal) having pulses that are proportionate to the movement distance of the carriage 31 from the linear encoder 50. The controller 40 acquires the position of the carriage 31 in the main scanning direction X (carriage position) from the number count of the number of edges of the pulses of the encoder pulse signal while acquiring the movement direction of the carriage on the basis of the result of comparing signal levels of A-phase and B-phase encoder pulse signals. Further, the controller 40 generates ejection timing signals for determining the ejection timing of the recording heads 33 on the basis of the encoder pulse signal from the linear encoder 50. The controller 40 creates head control data that a head driving circuit in the recording head 33 can use from the print image data in the print data PD, and transmits the head print data by the data of the one main scanning (one pass) of the carriage 31 to the recording head 33 at each time through the HCUs 45. The head driving circuit in the recording head 33 is synchronized with the ejection timing from the nozzle that performs ejecting on the basis of the head control data and controls ejection of the recording heads 33.

As shown in FIG. 2, the controller 40 includes a CPU 51 (Central Processing Unit), an ASIC 52 (Application Specific Integrated Circuit), a ROM 53, a RAM 54, and a non-volatile memory 55. The CPU 51 performs various processes for print control by executing programs stored in the ROM 53 and the non-volatile memory 55. Further, the ASIC 52 performs data processing of the recording system, including an image process of the print data PD.

Further, as shown in FIG. 2, the control device C includes a mechanism controller 43 connected to the output side (the control downstream side) of the controller 40 through a communication line SL1. The controller 40 gives an instruction of driving the mechanical mechanism 44 to the mechanism controller 43 by transmitting a command included in the print data PD at a predetermined timing. The mechanism controller 43 takes charge of controlling the driving of a mechanical mechanism 44 mainly including the transport system and the carriage driving system in a predetermined sequence on the basis of the command received from the controller 40. In this operation, the control of the driving of the mechanical mechanism 44 by the mechanism controller 43 is performed by the controller 40 taking an order of transmitting the next command when receiving a response saying that a sequence operation of the mechanical mechanism 44 according to the transmitted command is finished from the mechanism controller 43.

As shown in FIG. 2, the mechanical mechanism 44 includes a transport motor 61 included in the transport system, a first carriage motor (hereafter, referred to as a first CR motor 62) and a second carriage motor (hereafter, referred to as a second CR motor 63), which are included in the carriage driving system. The transport motor 61, the first CR motor 62, and the second CR motor 63 are connected to the mechanism controller 43 through the motor driving circuit 60. The transport motor 61 is provided to drive the transport mechanism composed of the rollers 21 to 27, the shafts 20 and 28, and the like.

Further, the first CR motor 62 is a driving source for driving the carriage 31 in the main scanning direction X and the second CR motor 63 is a driving source for driving the carriage 31 in the sub-scanning direction Y. In the lateral scan method, main scanning (pass) that performs printing of one pass by ejecting ink from the recording head 33 while moving the carriage 31 in the main scanning direction X and sub-scanning that performs sub-scanning that shifts the recording head 33 to the print position of the next pass by driving the carriage 31 at a predetermined pitch in the sub-scanning direction are alternately repeated a predetermined number of times (M times). Further, printing of one lateral scanning is performed by a predetermined number of times of main scanning (pass). Further, in the embodiment, an example of a transport unit is implemented by the transport motor 61 and the transport mechanism. Further, an example of a driving unit (driving source) that moves the recording section is implemented by the first CR motor 62 and the second CR motor 63.

Further, as shown in FIG. 2, the mechanical mechanism 44 includes a heater 19A and a drying device 16 included in a drying system, a suction device 34, and a maintenance device 35, which are electrically connected with the mechanism controller 43. Further, a power switch 65, an encoder 66, and temperature sensors 67 and 68 are connected, as an input system, to the mechanism controller 43. The power of the printer 11 is turned on/off by turning on/off the power switch 65.

Further, the mechanism controller 43 controls driving of the motors 61 to 63, the suction device 34, and the maintenance device 35 in accordance with various communication commands received from the controller 40 through the communication line SL1. The encoder 66 detects rotation of the rotary shaft of the transport driving system having the transport motor 61 as a power source and the mechanism controller 43 detects the transport amount of and the transport position of the sheet 13 by using detection signals (encoder pulse signals) of the encoder 66.

Further, the temperature sensor 67 detects the surface temperature of the support 19. The mechanism controller 43 performs temperature control for adjusting the surface temperature of the support base 19 to a set temperature on the basis of a detection temperature of the temperature sensor 67. The temperature sensor 68 detects furnace-inside temperature (drying temperature) of the drying device 16. The mechanism controller 43 performs temperature control for adjusting the inter-furnace temperature of the drying device 16 to a set temperature on the basis of a detection temperature of the temperature sensor 68.

The control device C performs a transport operation that transports the sheet 13 to dispose the next print area of the sheet 13 onto the support base 19, a suction operation that sucks the print area of the sheet 13 to the support base 19, a printing operation (recording operation) on the sheet 13 by the recording head 33, and a releasing operation that releases the suctioned sheet 13 after one (one-frame) printing is finished.

Figure 3:
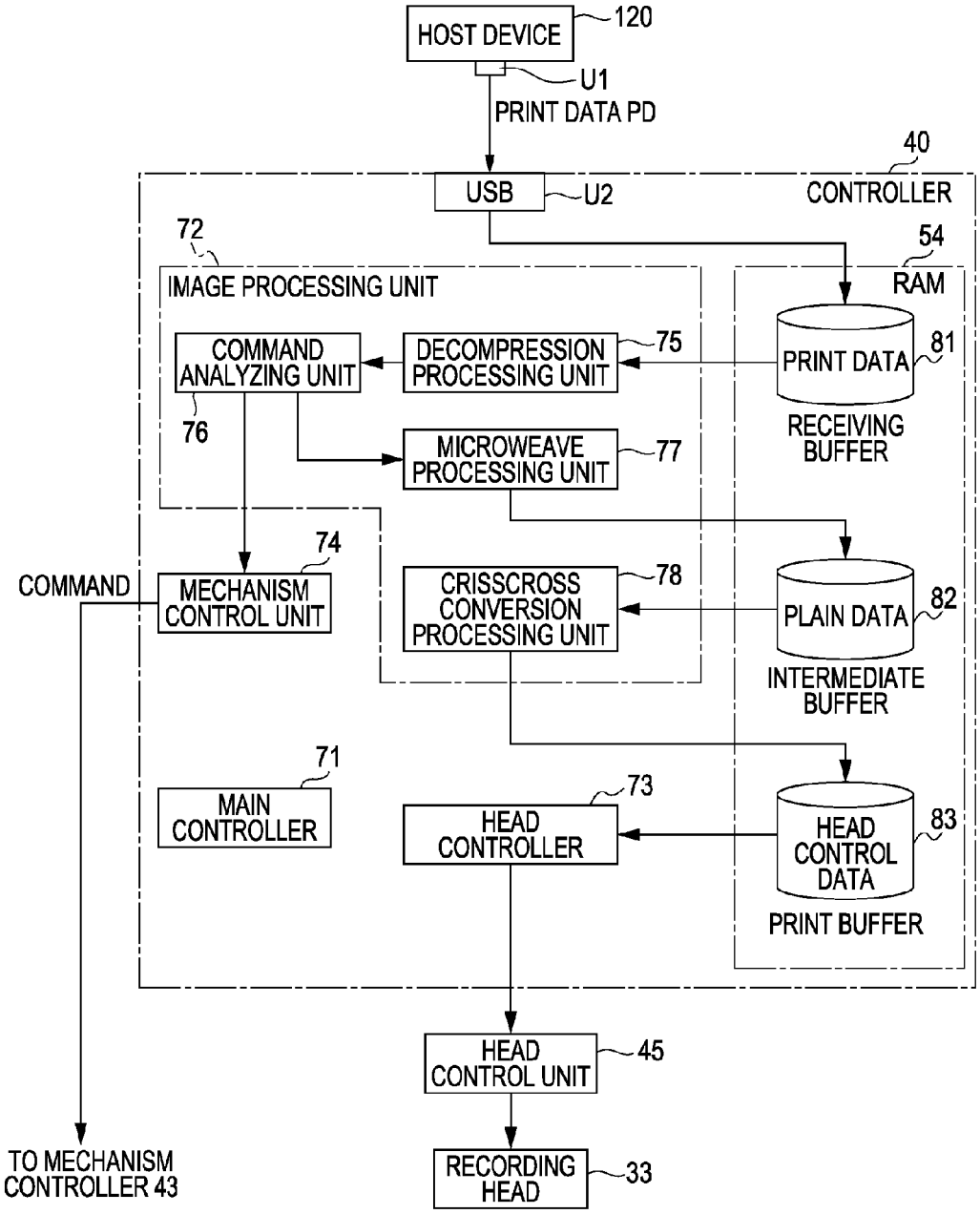
FIG. 3 is a block diagram illustrating the functional configuration of a controller.

FIG. 3 is a block diagram showing the functional configuration of the controller 40. As shown in FIG. 3, a functional unit implanted when the CPU 51 executes the program and a functional unit implanted by various electronic circuits in the ASIC 52 are disposed in the controller 40. That is, as shown in FIG. 3, the controller 40 includes a main control unit 71, an image processing unit 72, a head control unit 73, and a mechanism control unit 74. Further, the image processing unit 72 includes a decompression processing unit 75, a command analyzing unit 76, a microweave processing unit 77, and a crisscross conversion processing unit 78. Further, the units 71 to 78 are implemented, for example, by combination of software and hardware, but may be implemented only by software or only by hardware.

A receiving buffer 81, an intermediate buffer 82, and a print buffer 83 are disposed in the RAM 54. The print data PD that the serial communication port U2 (USB port) receives from the host device 120 is stored in the receiving buffer 81.

Next, the units 71 to 78 shown in FIG. 3 are described.

The main control unit 71 generally controls the units 72 to 78.

The image processing unit 72 performs an image process, such as a decompression process of the print data PD, a command analyzing process, a microweave process, a crisscross conversion process, using the units 75 to 78 therein. In detail, the decompression processing unit 75 performs a decompression process of the print data PD (compressed data) stored in the receiving buffer 81. The decompressed print data PD includes plain data MD (print image data) and print command written in print language. The command analyzing unit 76 analyzes the command in the decompressed print data PD and transmits the command to the mechanism control unit 74.

The microweave processing unit 77 performs a microweave process on the plain data MD. The microweave process is a data process for performing printing in a microweave printing method (interlaced recording method) that is performed to suppress position variation of the print data due to nozzle position variation of the recording head 33. One dot line of the print dots in the main scanning direction X, which is formed by landing of the ink droplets intermittently ejected from the nozzle 38 on the sheet 13 by the main scanning of the recording unit 30, is called a "raster line". In the microweave process, a pass dividing process of changing the order of the pixel data to be printed in M passes and dividing the image data for each pass such that the gap between raster lines adjacent to each other in the sub-scanning direction Y does not depends on the gap between nozzles adjacent to each other in the sub-scanning direction Y is performed. In the embodiment, the microwave process divides the image data for each pass such that the gap (line-feed) of the raster lines printed in the first pass of the M passes is filled with a raster line printed in the second and following passes.

That is, one lateral scanning is performed by drawing maximally n raster lines by printing first pass by using all (n) the nozzles, drawing a raster line such that the raster line the previous pass is covered by the second pass, and repeating this process up to the M-th pass such that all of the line gaps of the first raster line are filled. Banding (stripped non-uniform intensity) that extends in the main scan direction and is caused by the difference between the line gaps of the rater lines due to the position difference (difference in nozzle pitch) in the sub-scan direction Y of the nozzle is suppressed by the lateral scanning that is cycled with M passes. The plain data MD after the microweave process is sequentially transmitted from the microweave processing unit 77 and stored in the intermediate buffer 82.

The crisscross conversion processing unit 78 performs a crisscross conversion process on the plain data MD after the microweave process which is transmitted from the intermediate buffer 82. The plain data MD is data sequentially arranged for displaying pixels. In the crisscross conversion process, the alignment sequence for display in the transverse direction (alignment direction of the nozzle lines) is converted into the alignment sequence in the longitudinal direction (the nozzle line direction) in accordance with the ejection order for ejecting ink droplets from the nozzles 38 of the recording heads 33. That is, the alignment sequence of the pixels sequentially aligned in the original transverse direction is converted into the alignment sequence in the longitudinal direction according to the ejection order, so as to be in the order of 180 pixels ejected first from 180 nozzles 38 for one pass, 180 pixels ejected in the second time, . . . and 180 pixels finally ejected. The head control data HD created after the crisscross conversion process is transmitted from the crisscross processing unit 78 and stored in the print buffer 83.

The head control unit 73 divides the head control data HD transmitted from the print buffer 83 for each recording head 33 and sequentially transmits the divided data to the head control units 45 (HCU), respectively. Further, the HCUs 45 sequentially transmit the head control data HD to the recording heads 33. The head driving circuit (not shown) in the recording head 33 controls driving of the ejection driving elements of the nozzles 38 on the basis of the head control data HD such that the nozzles 38 eject ink droplets. In this operation, the ejection timings of the recording heads 33 are achieved by the head driving circuit controlling the driving timing of the ejection driving elements on the basis of the ejection timing signals generated by the head control unit 73, based on an encoder pulse signal of a linear encoder 50. Further, data transmission between the image processing unit 72 and the RAM 54 and between the RAM 54 and the head control unit 73 is performed by a DMA controller (not shown) in accordance with instructions of the CPU 51.

Further, the mechanism control unit 74 shown in FIG. 3 transmits the command received from the command analyzing unit 76 to the mechanism controller 43. The command may be, for example, a transport command, a suction command, a first carriage starting command (main scanning command), a second carriage starting command (sub-scanning command), and a releasing command. The mechanism control unit 74 transmits a command to the mechanism controller 43 at an appropriate timing according to the progress of the mechanism controller 43.

For example, when the command is the transport command, the mechanism controller 43 shown in FIG. 2 transports the sheet 13 by driving the transporting motor 61 in accordance with the transport command. Further, when the command is the main scanning command, the mechanism controller 43 moves the carriage 31 in the main scanning direction X by driving the first CR motor 62 in accordance with the main scanning command. In this operation, the recording heads 33 controlled by the controller 40 eject ink droplets from the nozzles 38 and one-pass printing is performed on the print area of the sheet 13. Further, the mechanism controller 43 moves the carriage 31 to the next main scanning position in the sub-scanning direction Y by driving the second CR motor 63 in accordance with a sub-scanning command, every time one pass is finished. In the embodiment, the mechanism controller 43 transports the sheet 13 by a predetermined mount in the transport direction (downstream in the main scanning direction X) by driving the transporting motor 61 in accordance with transport command in sub-scanning. That is, the sheet 13 is transported for each pass. Thereafter, one (one-frame) image (product) is continuously printed by continuously performing lateral scanning, which has a cycle of M passes of the recording unit 30, by alternately repeating the main scanning, sub-scanning, and transporting of the recording unit 30.

In the embodiment, the sheet 13 is transported by a predetermined amount, in addition to the sub-scanning, every time one-pass printing is finished in one lateral scanning. In the one main scanning, a plurality of raster lines is drawn in the sub-scanning direction Y by the nozzles. In the second to M-th passes, a plurality of raster lines is drawn for each pass to sequentially fill the plurality of raster lines drawn in the first pass for each pass. Further, in the printer 11 of the embodiment, multi-plate printing that prints the same or different images (plate) to overlap each other in the same area of the sheet 13 is possible.

Figure 5:
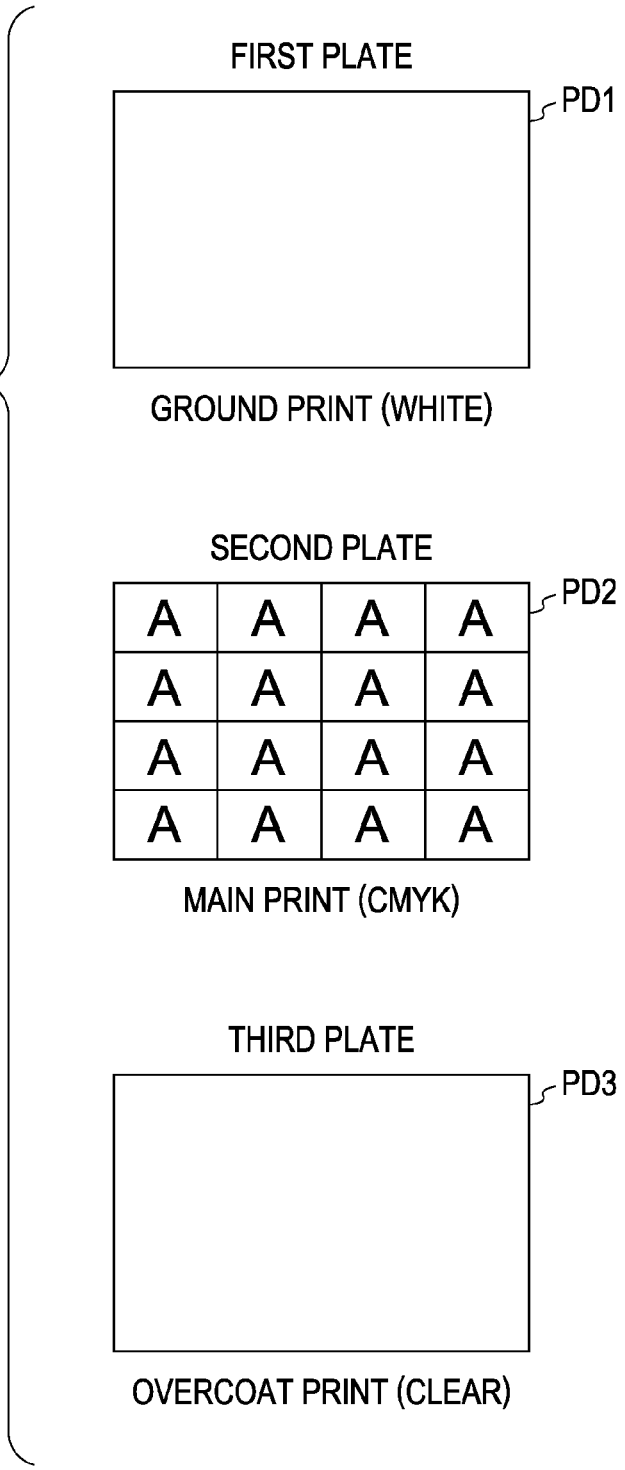
FIG. 5 is a schematic view showing image data for the plates in triple-plate printing.

FIG. 5 shows images of plates when triple-plate printing is performed. The example of FIG. 5 is an image for label printing that arranges labels including the image of a character "A" in a plurality of frames and prints a plurality of labels at one time. Triple-plate printing is composed of first to third plate images (plate images) sequentially from the lower layer. That is, as shown in FIG. 5, there are first-plate image data (hereafter, "first plate image data PD1"), a second-plate image data (hereafter, "second plate image data PD2"), and third-plate image data (hereafter, "third plate image data PD3").

The first plate image data PD1 is image data of a base image (beta image) for beta printing (basic printing) of a white base layer with white ink. The second plate image data PD2 is image data for main printing for printing a main image in color or gray scale with CMYK-based ink (CMYK printing). The main images in the example of FIG. 5 are a plurality of frame images with a plurality of characters "A" of the labels arranged. The third plate image data PD3 is image data of an overcoat image (beta image) for beta printing of an overcoat layer with transparent ink (clear ink).

In the embodiment, the "base image", the "main image", and the "overcoat image" are printed from the upstream side in the transport direction in the division regions, basically in one pass, by dividing the print region into N the same as the number N of the plates in the main scanning direction X. In this operation, a printing method that moves the print positions of the passes by a predetermined amount downstream in the transport direction by transporting the sheet for each pass is employed.

Figure 7:
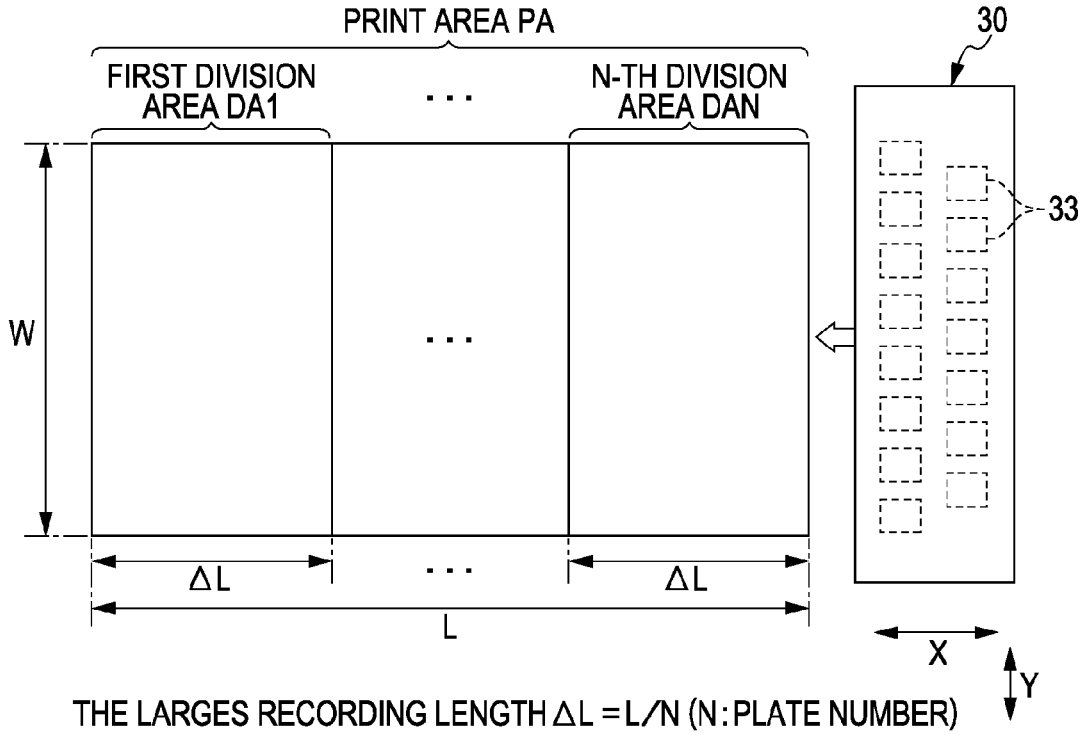
FIG. 7 is a schematic view illustrating division regions in a print area.

Terminologies are defined first as follows from FIG. 7. The "print area PA" shown in FIG. 7 is shown by rectangular areas on the support base 19 which indicates the maximum range (the maximum recording region) where the recording unit 30 can perform printing by one lateral scanning. For example, the print area PA is not moved even if the sheet 13 is transported. As shown in FIG. 7, the main scanning direction length of the print area PA is a repeat length L and the sub-scanning directional width is an area width W. In the printer 11, the maximum length of a raster line that is printed in one pass is "L".

Further, for label printing, a rectangular image unit where labels are arranged in a plurality of frames is called a "page". Further, a rectangular image unit where one page or a plurality of pages are aligned such that one page image (a plurality of frame images) are stored in a print area PA is called a "frame". Further, the length of the "frame" in the main scanning direction is called a frame length Lf and the width in the sub-scanning direction is called a frame width Wf. The repeat length L is set as a value of the frame length Lf or more ($L \geq Lf$). In the embodiment, the frame is set the same as the print area PA. That is, the print area PA is set such that the repeat length L is the same as the frame length Lf and the area width W is the same as the frame width Wf. Further, in label printing or the like, since there is a space around the edge or gaps between the labels in a page, generally, ink is ejected only to the label portion in the repeat length L or a portion wider than the label portion as much as the margin.

As shown in FIG. 7, in the embodiment, the print area PA is equally divided into N the same as the number N of plates in the main scanning direction X and the division regions are set at a first division region DA1, a second division region DA2, . . . , and an N-th division region DAN sequentially from the upstream side in the transport direction. First plate to N-th plate raster lines are printed sequentially from the upstream side in the transport direction, in the N division regions, in one pass. However, The printing order in the same division region is that the i+1-th plate is printed on the print layer of the i-th plate (i=1, 2, . . . , N−1) sequentially from the lower layer to the upper layer. That is, the printing order of the plates on the same division area is the overlapping order of the first plate to N-th plate. Further, the division regions are described as a "division area DA", unless the division areas DA1, DA2, . . . , DAN are specifically discriminated.

The length of the division region DA in the main scanning direction is the maximum recording length ΔL that can be recorded in the division region DA. When the sending amount (transporting amount) of the sheet 13 for each pass is a main scanning sending amount Δx, the main scanning sending amount Δx is given by $\Delta x = \Delta L/M$, which is a value obtained by dividing the maximum recording length ΔL of the division region DA by the number M of passes of one lateral scanning. In the lateral scanning method of the related art, a sheet is transported as much as the length of one frame when one lateral scanning is finished only by alternately performing main scanning and sub-scanning during one lateral scanning, but in the embodiment, the sheet 13 is transported by the main scanning sending amount Δx for each pass.

FIGS. 8A to 9F show an example of printing N plates in an M-pass printing method in which one lateral scanning is performed with M passes. However, the figures show an example of performing double-plate printing implemented by two plates of a base image and a main image by lateral scanning that has a cycle of four passes, where M=4 and N=2, in order to simplify the description. Since the plate number N is 2, the print area PA is divided into two of a first division region DA1 and a second division region DA2 in the main scanning direction X. Further, the maximum recording length ΔL is L/2, the main scanning sending amount Δx is ΔL/4, and the sub-scanning sending amount Δy is Δp/4. Further, the three-order number "KiJ" following the reference numeral "RL", which indicates the raster line RL in FIGS. 8A and 9F, sequentially show "K-th lateral scanning", the "i-th plate" and the "J-th pass" from the front. Further, the left-right direction is the transport direction in the figures.

Figure 8A:
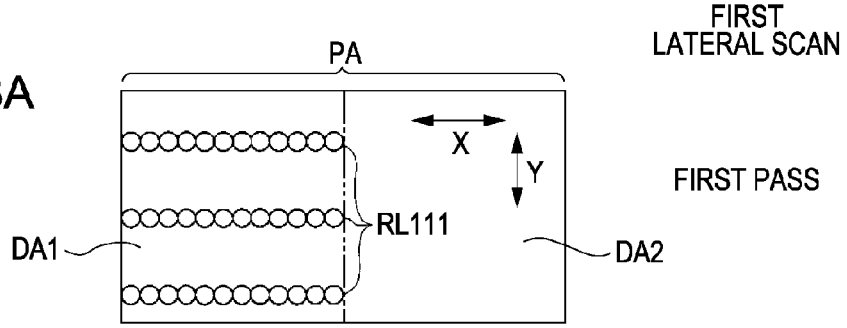
FIGS. 8A to 8F are print image views showing a printing process of first lateral scanning in double-plate printing.
Figure 8B:
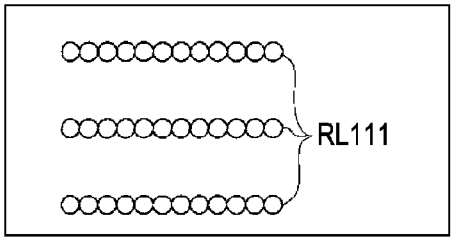

In the example of FIG. 8A, white-dotted raster lines RL111 are printed with nozzle pitch line spaces in the sub-scanning direction Y by one-pass operation of the recording unit 30, in the first division region DA1, at the upstream half (left in the figure) of the print area PA, by one pass. When the first pass is finished, the sheet 13 is transported by the main scanning sending amount Δx (=ΔL/4) while the recording unit 30 is shifted by the sub-scanning sending amount Δy (=Δp/4), such that they are positioned for the second pass (FIG. 8B).

Figure 8C:
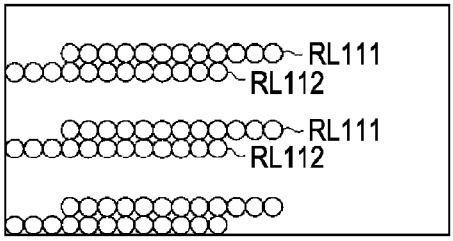

Further, as shown in FIG. 8C, as printing of the second pass is performed, white-dotted raster lines RL112 of the second pass are printed upstream (left in FIGS. 8A to 8F) in the transport direction by Δx, in the next lines of the white-dotted raster lines RL111 of the first pass. Further, when the second pass is finished, the sheet 13 is transported by the main scanning sending amount Δx while the recording unit 30 is shifted by the sub-scanning sending amount Δy, such that they are positioned for the third pass.

Figure 8D:
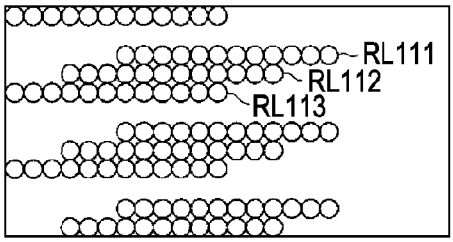

Further, as shown in FIG. 8D, as printing of the third pass is performed, white-dotted raster lines RL113 of the third pass are printed upstream in the transport direction by Δx, in the next lines of the white-dotted raster lines RL112 of the second pass. Further, when the third pass is finished, the sheet 13 is transported by the main scanning sending amount Δx while the recording unit 30 is shifted by the sub-scanning sending amount Δy, such that they are positioned for the fourth pass.

Figure 8E:
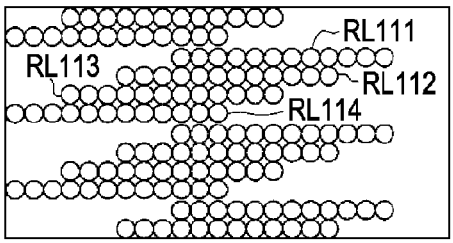

Further, as shown in FIG. 8E, as printing of the fourth pass is performed, white-dotted raster lines RL114 of the fourth pass are printed upstream in the transport direction by Δx, in the next lines of the raster lines RL113 of the third pass. Further, when the fourth pass is finished, the sheet 13 is transported by the main scanning sending amount Δx (FIG. 8F) while the recording unit 30 is shifted by the sub-scanning sending amount (M−1)·Δy in the opposite direction (upward in FIGS. 8A to 8F) and returns to the position for the first pass.

Figure 9A:
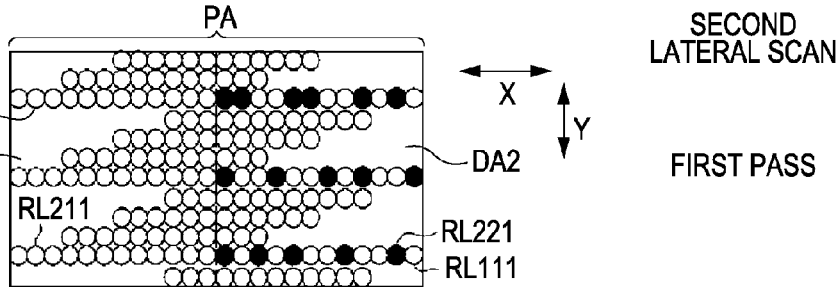
FIGS. 9A to 9F are print image views showing a printing process of second lateral scanning in double-plate printing.

Next, in the second lateral scanning, as shown in FIG. 9A, white-dotted raster lines RL211 are printed with nozzle pitch line spaces in the sub-scanning direction Y by one-pass operation of the recording unit 30, in the first division region DA1 of the print area PA, in the earlier half of the first pass. Further, color-dotted raster lines RL221 are printed with nozzle pitch line spaces in the sub-scanning direction Y in the second division region DA2 of the print area PA, in the later half of the first pass. When the first pass is finished, the sheet 13 is transported by the main scanning sending amount Δx while the recording unit 30 is shifted by the sub-scanning sending amount Δy, such that they are positioned for the second pass.

Figure 9B:
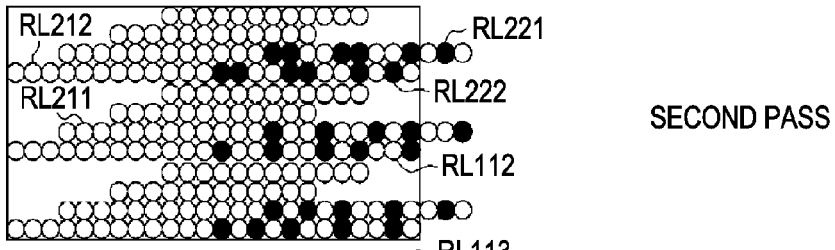

As shown in FIG. 9B, the white-dotted raster lines RL212 of the second pass are printed upstream by Δx in the transport direction, in the next lines of the white-dotted raster lines RL211 of the first pass by performing the second pass printing while the color-dotted raster lines RL222 are printed by Δx in the transport direction, in the next lines of the color-dotted raster lines RL 221 of the first pass, in the second division region. Further, when the second pass is finished, the sheet 13 is transported by the main scanning sending amount Δx while the recording unit 30 is shifted by the sub-scanning sending amount Δy, such that they are positioned for the third pass.

Figure 9C:
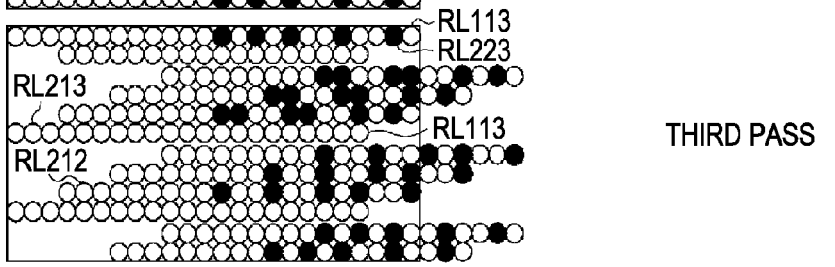

As shown in FIG. 9C, the white-dotted raster lines RL213 of the third pass are printed upstream by Δx in the transport direction, in the next lines of the white-dotted raster lines RL212 of the second pass by performing the third pass printing while the color-dotted raster lines RL223 are printed by Δx in the transport direction, in the next lines of the color-dotted raster lines RL 222 of the second pass, in the second division region DA2. Further, when the third pass is finished, the sheet 13 is transported by the main scanning sending amount Δx while the recording unit 30 is shifted by the sub-scanning sending amount Δy, such that they are positioned for the fourth pass.

Hereafter, similarly, when the fourth pass printing is performed (FIG. 9D) and the fourth pass is finished, the sheet 13 is transported by the main scanning sending amount Δx (FIG. 9E) while the recording unit 30 is shifted by the sub-scanning sending amount (M−1)·Δy in the opposite direction (upward in FIGS. 9A to 9F) and returns to the position for the first pass. That is, the recording unit 30 returns to the position for the first pass of the next lateral scanning.

As the transporting of ΔL/M is performed M times for each pass by one lateral scanning, transporting is generally performed for the maximum recording length ΔL that is the length of the division region DA in the main scanning direction. That is, the sheet is transported by one division region DA for each lateral scanning. Therefore, an upper layer is printed over a lower layer printed in the previous lateral scanning, in the present lateral scanning. Further, as these operation is continuously repeated, multi-plate printing is performed while the time interval from printing of the lower layer (first plate) to printing of the upper layer (i+1-th plate) is ensured as much as the necessary time of one lateral scanning.

Figure 8F:
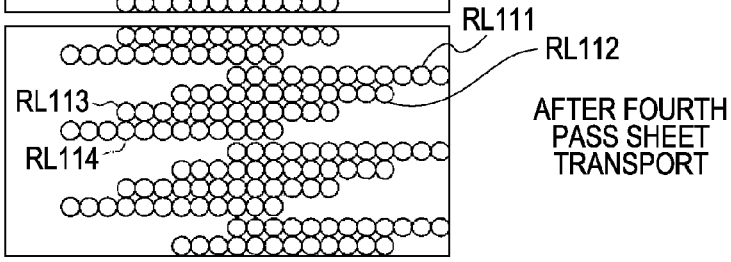

Further, since transporting of ΔL/M is performed for each pass and the raster lines RL are deviated by ΔL/M in the main scanning direction X for each pass, the image printed by one lateral scanning has an image shape with both ends in a zigzag shape (saw teeth shape) in the main scanning direction X (FIGS. 8E and 8F). Further, an image having the same shape is printed by the present lateral scanning such that the zigzag shape at the upstream end of the image printed in the present lateral scanning in the transport direction is engaged with the next zigzag shape. Therefore, the boundary between the previous and present raster lines is deviated in the main scanning direction X, such that banding that extends in the sub-scanning direction is suppressed. In the embodiment, the row regions where the raster lines RL are printed correspond to the row recording regions that are the recording target region, within the region width of the division region (the maximum recording length ΔL that is the main scanning direction length). Further, since the dots printed (recorded) in the row recording region depends on the image data, dots are not printed in all of the row recording regions, but there are row recording regions without dots.

Although four pass/plate is described in the example, it is the same as eight pass/plate. That is, in double-plate printing, the main scanning sending amount Δx is L/16 and the sub-scanning sending amount Δy is Δp/4. Further, this is the same as in multi-plate printing of three or more. For example, in triple-plate printing, the base image is printed in the first division region DA1 in the first lateral scanning, the base image is printed in the first division region DA1 while the main image is printed over the base image of the first lateral scanning in the second division region DA2 in the second lateral scanning. Further, the base image is printed in the first division region DA1 and the main image is printed over the base image of the first pass in the second division region DA2 in the third lateral scanning while the overcoat image is printed over the main image of the second lateral scanning in the third division region DA3.

Figure 10A:
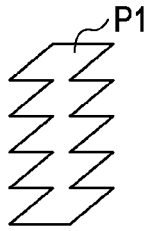
FIGS. 10A to 10D are schematic views illustrating the print order for each number of times of lateral scanning in triple-plate printing.
Figure 10B:
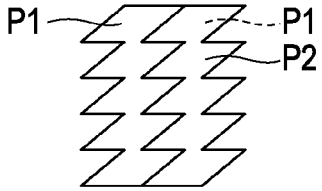
Figure 10C:
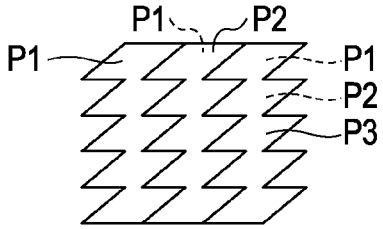
Figure 10D:
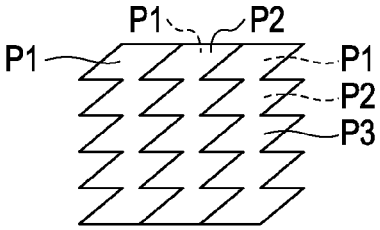
Figure 11:
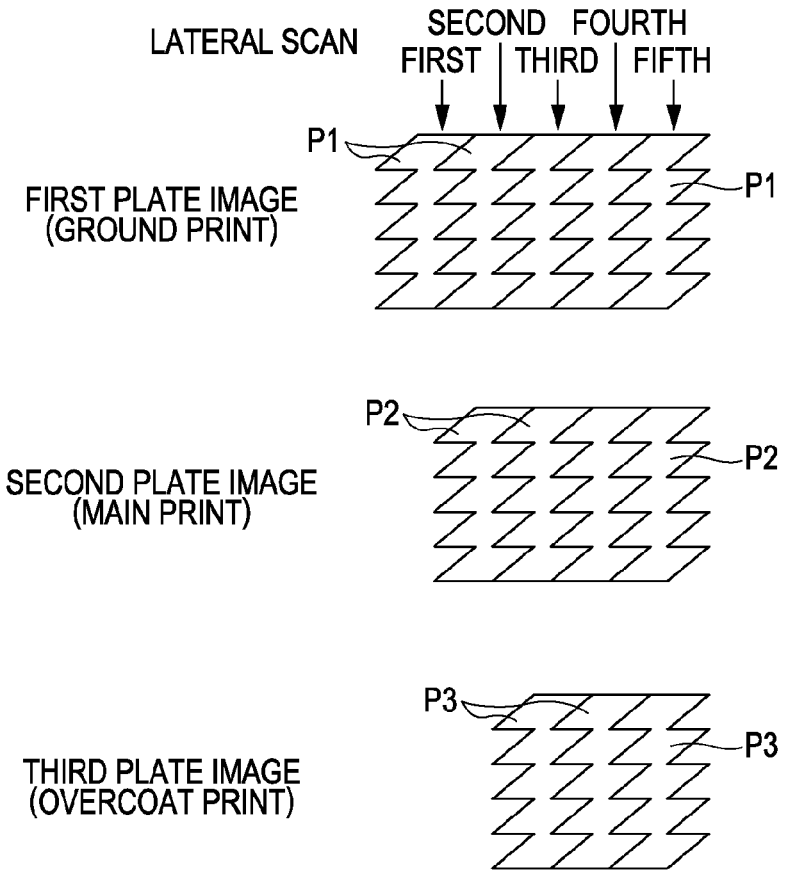
FIG. 11 is a schematic view illustrating the print order for each plate image in triple-plate printing.

FIGS. 10A to 11 show the printing order of lateral scanning unit in the example of triple-plate printing. FIGS. 10A to 10D show the printing order for each number of times of lateral scanning and FIG. 11 shows the printing order for each plate of lateral scanning. As shown in FIG. 10A, a white base image P1 is printed in the first lateral scanning. In this process, since the sheet is transported for each pass, the base image P1 is printed in a print pattern with both side in zigzag shape (saw teeth shape) in the main scanning direction in one lateral scanning, as shown in FIG. 10A.

Next, as shown in FIG. 10B, a white base image P1 is printed in the first division region DA1 in the second lateral scanning and a color main image P2 is printed over the base image P1 printed in the first lateral scanning, in the second division region DA2. In this operation, since the sheet is transported for each pass, the base image P1 and the main mage P2, which are printed in the first lateral scanning, as shown in FIG. 10B, are printed in a print pattern with both ends in a zigzag shape in the main scanning direction. In this process, as shown in FIG. 11, the base image P1 of the first lateral scanning and the base image P1 of the second lateral scanning are jointed such that the portions of the zigzag shapes are alternately engaged.

Further, as shown in FIG. 10C, a white base image P1 is printed in the first division region DA1, a color main image P2 is printed over the base image P1 of the second lateral scanning, in the second division region DA2, and an overcoat image P3 is printed over the main image P2 of the second lateral scanning, with transparent ink in the third division region DA3, in the third lateral scanning. In this operation, since the sheet is transported for each pass, the base image P1, the main mage P2, and the overcoat image P3, which are printed in the first lateral scanning, as shown in FIG. 10C, are printed in a print pattern with both ends in a zigzag shape in the main scanning direction. In this process, as shown in FIG. 11, the main image P2 of the second lateral scanning and the main image P2 of the third lateral scanning are jointed such that the portions of the zigzag shapes are alternately engaged.

Further, as shown in FIG. 10D, a white base image P1 is printed in the first division region DA1, a color main image P2 is printed over the base image P1 of the third lateral scanning, in the second division region DA2, and an overcoat image P3 is printed over the main image P2 of the third lateral scanning, with transparent ink in the third division region DA3, in the fourth lateral scanning. In this operation, since the sheet is transported for each pass, the base image P1, the main mage P2, and the overcoat image P3, as shown in FIG. 10C, are printed in a print pattern with both ends in a zigzag shape in the main scanning direction. In this process, as shown in FIG. 11, the overcoat image P3 of the third lateral scanning and the overcoat image P3 of the fourth lateral scanning are jointed such that the portions of the zigzag shapes are alternately engaged. Further, the zigzag print patterns in FIGS. 10A to 11 are examples when the front of the sheet 13 is printed, such as beta printing, and when there are gaps between the images, the portions of the non-printed gaps are not necessarily formed in a zigzag shape.

In the embodiment, a standby time for one lateral scanning is ensured until the i+1-th plate is printed on the upper layer of the i-th plate (i is a natural number). Therefore, the standby time is ensured as a drying time until the i+1-th plate (main image P2 and overcoat image P3) is printed on the i-th plate (base image P1 and main image P2), which is the lower layer. Accordingly, it is easy to avoid permeation of the ink when the i+1-th plate is printed on the i-th plate. That is, it is easy to avoid permeation of the main image P2 printed on the base image P1 or permeation of the main image P2 when the overcoat image P3 is printed on the main image P2.

Further, since the print position is shifted for each pass in the main scanning direction and both ends of the print range of the print plates are formed in zigzag patterns in the main scanning direction, for example, banding that extends in the sub-scanning direction in the label is difficult to be generated, even if the boundary of the plates is in the label. As described above, in the embodiment, banding that extends in the sub-scanning direction Y is suppressed by transporting of the sheet, which is performed for each pass, by suppressing banding that extends in the main scanning direction and banding that extends in the sub-scanning direction X by microweave printing.

Figure 6:
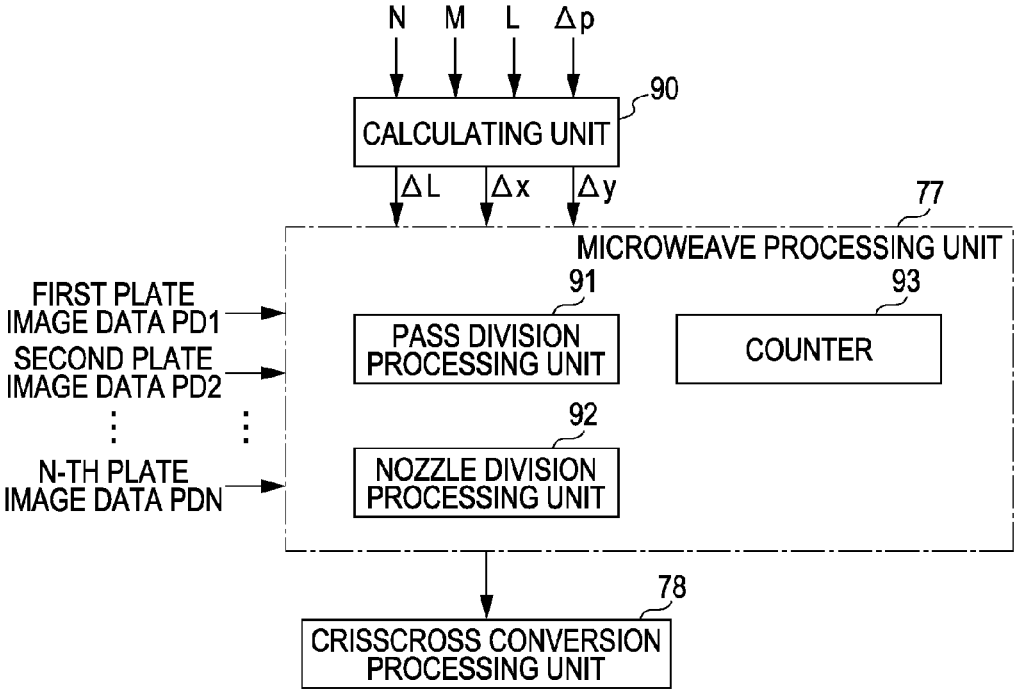
FIG. 6 is a block diagram showing the functional configuration of a microweave processing unit.

The main control unit 71 and the microweave processing unit 77 have the configuration shown in detail in FIG. 6 in order to make head control data that can be printed from image data in the print order described above. That is, as shown in FIG. 6, a calculating unit 90, a pass division processing unit 91 disposed in the microweave processing unit 77, a nozzle designation processing unit 92, and a counter 93 are provided. The calculating unit 90 is disposed, for example, in the main control unit 71.

The microweave processing unit 77 inputs first plate image data PD1, second plate image data PD2, . . . , N-th plate image data PDN. The pass division processing unit 91 performs a pass division process that divides the plate image data PD1 to PD3 for each pass. In the embodiment, in order to print the raster lines of the three plate images in one pass in the third and the following lateral scanning, the pass division process is performed by extracting pixel line data of the portion corresponding to the passes in the corresponding division regions DA1 to DAN from the N plate image data PD1 to PDN, in consideration of the main scanning sending amount Δx deviated by transporting the sheet, which is performed for each pass, in the main scanning direction.

The nozzle designation processing unit 92 performs a process of nozzle separation that designates the pixel line data that has undergone pass division to the nozzles and an inter-line shifting process that shifts the arrangement position of the pixel data in the nozzle lines by addition dummy data to adjust the ejection timings in the nozzle lines of CMYK colors.

The crisscross conversion processing unit 78 performs a crisscross conversion process that reads out the plain data after the pass division per process unit from the intermediate buffer 82 and changes the order of the pixels of the plain data from the transverse direction to the longitudinal direction while reflecting the results of the nozzle designation process and the inter-line shifting process. Further, the head control data after the crisscross conversion process is stored in the print buffer 83.

The counter 93 performs a process of counting which number of pass is the target of the pass division process in the M passes and a process of counting the number of times of lateral scanning while the microweave process is performed. The calculating unit 90 calculates the control value that the microweave processing unit 77 uses for the pass division process and the nozzle designation process and transmits the value to the microweave processing unit 77. The pass division processing unit 91 performs the pass division process by extracting pixel line data corresponding to the information of the number of times of lateral scanning and the number of times of pass by using the calculated values, such as various control values acquired from the calculating unit 90, the number of passes and the number of times of lateral scanning that are counted by the counter 93.

Next, the control value that the calculating unit 90 calculates is described. As shown in FIG. 6, the calculating unit 90 inputs data of the plate number N, the pass number M, and the repeat length L. The plate number N is a value inputted by a user operating an operation unit 124. The pass number M is set as a value according to the print resolution determined from the print mode and the value is a large value such that the print resolution is high. In the embodiment, "four pass printing" of which the pass number M is 4 is set in a print mode with a low print resolution and "eight pass printing" of which the pass number M is 8 is set in a print mode with a high print resolution. As the repeat length L, the frame length Lf inputted by the user operating the operation unit 124 is used. However, a repeat length L stored in advance in the non-volatile memory 55 may be used, with the print area PA fixed.

The calculating unit 90 calculates various control values that are used for print control of the printer 11, using the acquired plate number N, pass number M, and repeat length L. The control value may be the maximum recording length ΔL, the main scanning sending amount Δx, and the sub-scanning sending amount Δy, which are recorded in one division area by one pass. The control values ΔL, Δx, and Δy are calculated by using the plate number N, pass number M, and repeat length L. That is, the maximum recording length ΔL is calculated from an equation, $\Delta L=L/N$. Further, the main scanning sending amount Δx is calculated from an equation, $\Delta x=\Delta L/M$. Further, the sub-scanning sending amount Δy is calculated from an equation, $\Delta y=\Delta p/M$ (see FIG. 7). Obviously, it is possible to employ an appropriate equation as an equation for calculating Δy, which makes it possible to acquire desired print resolution.

Figure 12:
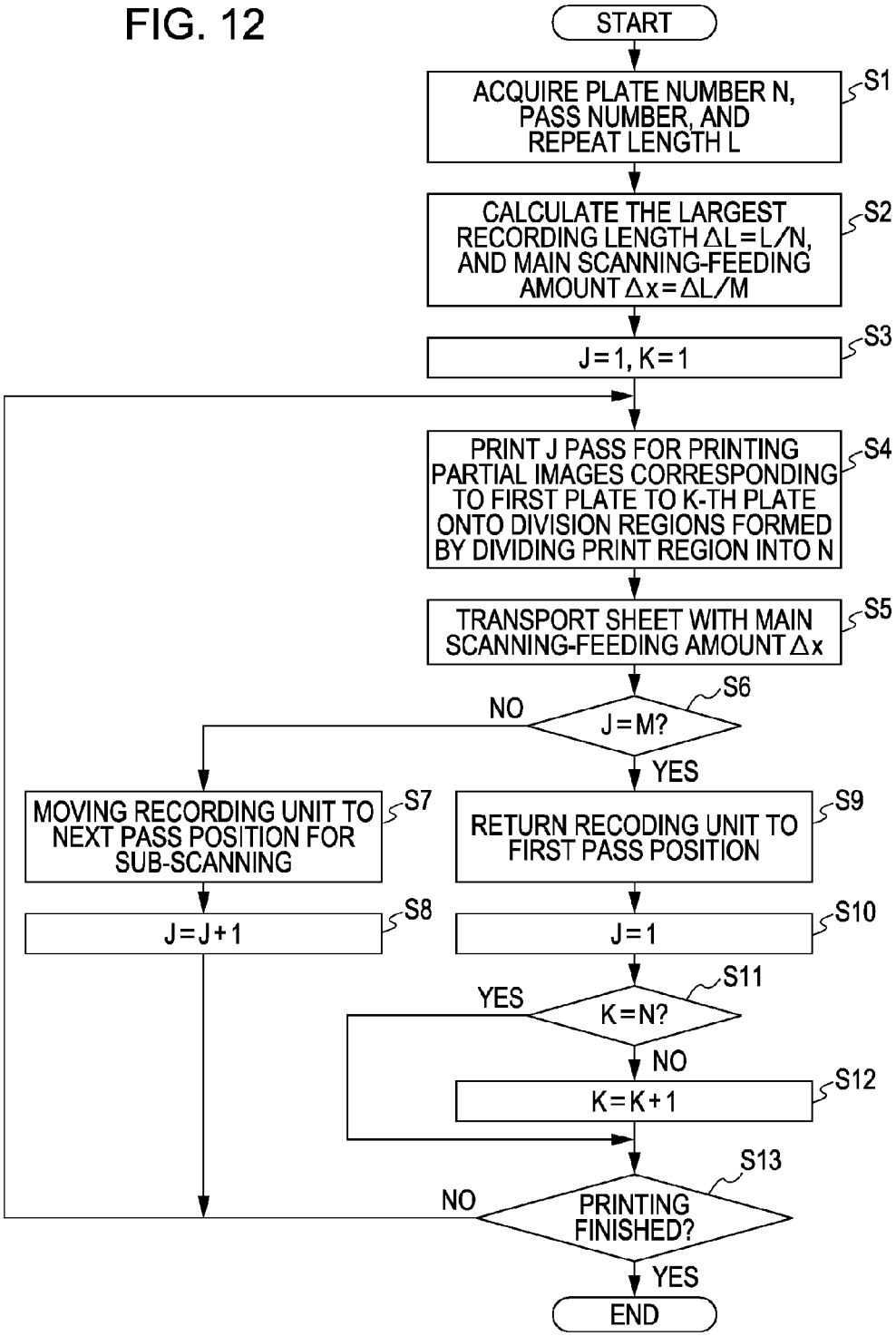
FIG. 12 is a flowchart showing printing process routine.

Next, the operation of the printer 11 is described with reference to the flowchart shown in FIG. 12. Further, the operation is described with reference to FIGS. 8A to 9F, if necessary. Further, the microweave process of sequentially applying the pass division process and the nozzle designation process to the plain data by the microweave processing unit 77 and a process of applying the crisscross conversion process to the plain data after the microweave process by the crisscross conversion processing unit 78 are performed together with the corresponding process or the process before the process by the flowchart. The head control data created by the microweave process and the crisscross conversion process is sequentially transmitted to the recording heads 33 through the HCUs 45 from the head control unit 73.

First, in step S1, the plate number N, pass number M, and repeat number L are acquired. In the embodiment, it is assumed that triple-plate printing and the print mode of low print resolution are set, and the plate number N is 3 and the pass number is 4.

In step S2, the maximum recording length ΔL=L/N and the main scanning sending amount Δx=ΔL/M are calculated.

In step S3, J=1 and K=1 are set. That is, the initial values of J and K are set in a counter (counter in the mechanism control unit), which is not shown. The count value J is a count value showing which pass the present pass is in M passes of one lateral scanning. The count value J is used to determine whether to return the recording unit 30 to the position for the first pass. Further, the count value K is a count value that is counted until the number of times of lateral scanning reaches the plate number N. The count value K is used to determine whether it reaches the number of times N (the same number of times as the plate number N) for performing all the N plate printing in one pass. That is, in the embodiment, only the first plate is printed in the first lateral scanning, the first plate and the second plate are printed in the second lateral scanning, and the first to N-th plates are printed in the N-th and the following lateral scanning. The count value K is used to determine whether the number of times of lateral scanning reaches the number of times until the N plates are all printed.

In step S4, printing of the J-th pass for printing partial images corresponding to the first to K-th plates in the division regions, respectively, which are acquired by dividing the print area PA into N (raster lines with the gaps of the nozzle pitch Δp in the sub-scanning direction Y), is performed. In the first pass (J=1) of the first lateral scanning (K=1), which is the present time, as shown in FIG. 8A, raster lines RL111 of the first plate (base image) are printed with white ink in the first division region DA1. Further, in the embodiment, the process in step S4 corresponds to a recording process that records a dot lines in the present row recording region.

In step S5, a sheet is transported by the main scanning sending amount Δx. That is, the sheet 13 is transported by the main scanning sending amount Δx by transmitting a main scanning command that designates the main scanning sending amount Δx by the mechanism control unit 74 to the mechanism controller 43, and by driving the transporting motor 61 on the basis of the received main scanning command by the mechanism controller 43. As a result, after the printing of the first pass, as shown in FIG. 8B, the sheet is transported by the main scanning sending amount Δx.

In step S6, whether J is equal to M is determined. That is, it is determined whether one lateral scanning is finished. When J=M is not satisfied, the process proceeds to step S7, or for J=M, the process proceeds to step S9. The present time with J=1 (first pass) proceeds to step S7.

In step S7, the recording unit 30 is moved to the next pass position for sub-scanning. That is, the recording unit 30 is moved by the sub-scanning sending amount Δy for sub-scanning by transmitting a sub-scanning command that designates the sub-scanning sending amount Δy by the mechanism control unit 74 to the mechanism controller 43, and by driving the second CR motor 63 on the basis of the received sub-scanning command by the mechanism controller 43. Further, in the embodiment, the processes of step S4 and step S7 correspond to a main scanning position switching process.

Further, the J value is increased in the next step S8 and then the process returns to step S4. That is, the J value is increased to be J=2 and then the process proceeds to step S4.

Further, printing of the second pass is performed (S4). In the second pass, as shown in FIG. 8C, raster lines RL112 are printed with a deviation as much as ΔL/M (that is 1/M of the division region width) upstream in the main scanning direction X with respect to the raster lines RL111, in the next line of the raster lines RL111 of the first pass.

When the printing of the second pass is finished, the sheet is transported by the main scanning sending amount Δx (S5). Further, since it does not reach to the M-th pass (fourth pass in the embodiment) in the second pass (J=2) (J≠M) (negative determination in S6), the recording unit 30 is moved to the next pass position for sub-scanning (S6). Further, the J value is increased to be J=3 (S8) and then the process proceeds to step S4.

Further, printing of the third pass is performed (S4). In the third pass, as shown in FIG. 8D, raster lines RL113 are printed with a deviation as much as ΔL/M upstream in the main scanning direction X with respect to the raster lines RL112, in the next line of the raster lines RL112 of the second pass.

When the printing of the third pass is finished, the sheet is transported by the main scanning sending amount Δx (S5). Further, since it does not reach to the M-th pass in the third pass (J=3) (J≠M) (negative determination in S6), the recording unit 30 is moved to the next pass position for sub-scanning (S6). Further, the J value is increased to be J=4 (S8) and then the process proceeds to step S4.

Further, printing of the fourth pass is performed (S4). In the third pass, as shown in FIG. 8E, raster lines RL114 are printed with a deviation as much as ΔL/M upstream in the main scanning direction X with respect to the raster lines RL113, in the next line of the raster lines RL113 of the third pass.

When the printing of the fourth pass is finished, the sheet is transported by the main scanning sending amount Δx (S5). Therefore, the sheet 13 is disposed at the position in FIG. 8F. Further, since it is determined that J is equal to M (J=4 in the embodiment) (positive determination in step S6), the recording unit 30 is returned to the position for the first pass in step S9. That is, the recording unit 30 performs sub-scanning by the sub-scanning sending amount −3·Δy and is returned to the position for the first pass by transmitting a sub-scanning command that designates the main scanning sending amount −3·Δy by the mechanism control unit 74 to the mechanism controller 43, and by driving the second CR motor 63 on the basis of the received sub-scanning command by the mechanism controller 43. Further, J is returned to 1 in the next step S10.

Next, whether K is equal to N is determined in step S11. That is, it is determined whether the number of times of lateral scanning reaches a value equal to the plate number N. When K=N is not satisfied, the process proceeds to step S12, or for K=N, the process proceeds to step S13. Since K is 1 when the first lateral scanning is finished in the present time, the process proceeds to step S12.

In step S12, the K value is increased (K=K+1).

In step S13, whether printing is finished is determined. That is, when printing of an image for designated pages, based on print data, is finished, it is determined that printing is finished. For example, the main control unit 71 determines that printing is finished by counting the number of printed pages, when the count value reaches the designated number of pages. When pages to be printed remains and printing is not finished yet, the process returns to step S4, or when printing is finished, the corresponding routine is finished. Since the present time does not finish printing yet, the process proceeds to step S4.

As described above, in the first lateral scanning, the white raster lines RL111 to RL114 are printed in the first division region DA1 while shifting is performed by ΔL/M at each time in the main scanning direction X and only a base image is printed, in the M pass operations. That is, as shown in FIG. 8E, only the first plate image (base image) composed of the raster lines RL111 to RL114, which are each deviated by ΔL/M in the main scanning direction, is printed. In this operation, the positions of both ends in the main scanning direction of the raster lines RL111 to RL114 for each pass are each deviated by ΔL/M. Therefore, both ends of the base image printed in the first lateral scanning are formed in a zigzag shape (saw teeth shape) in the main scanning direction. Further, when the first lateral scanning is finished, the recording unit 30 returns to the position for the first pass and the sheet 13 is disposed in the state of FIG. 8F, that is, the start position of the second lateral scanning.

Next, the second lateral scanning is performed.

Figure 9D:
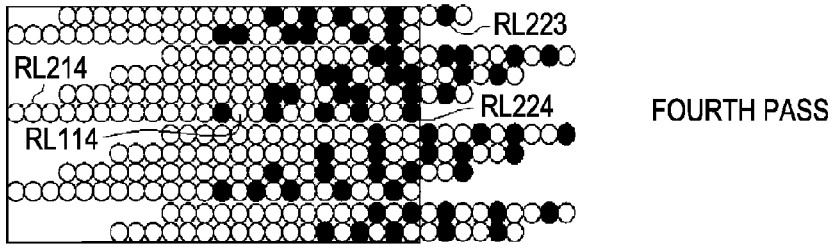
Figure 9E:
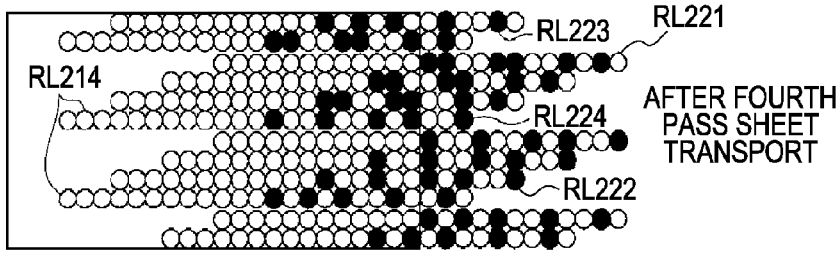
Figure 9F:
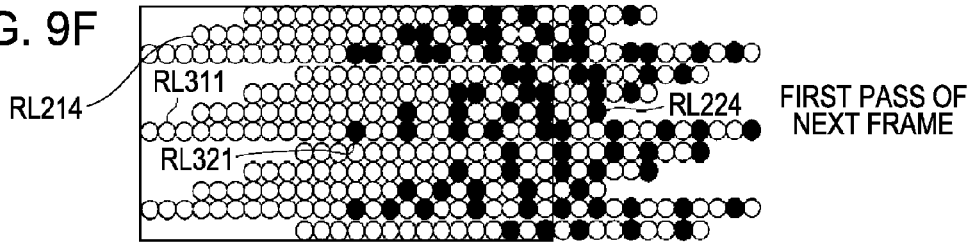

In step S4, printing of the J-th pass for printing partial images (raster lines) corresponding to the first plate to the third plate in the division regions acquired by dividing the print region into N is performed. In the first pass (J=1) of the second lateral scanning (K=2), which is the present time, as shown in FIG. 9E, raster lines RL211 of the first plate (base image) are printed with white ink in the first division region DA1 while raster lines RL211 (black dot lines in FIGS. 9A to 9F) are printed with color ink over the raster lines RL111 of the previous first pass in the second division region DA2.

When the first pass in the second lateral scanning is finished, the sheet is transported by the main scanning sending amount Δx (S5). Further, since it does not reach to the M-th pass in the first pass (J=1) (J≠M) (negative determination in S6), the recording unit 30 is moved to the next pass position for sub-scanning (S7). Further, the J value is increased (S8) and then the process proceeds to step S4.

Further, printing of the second pass is performed (S4). In the second pass, as shown in FIG. 9B, raster lines RL212 of the second pass are printed with white ink, adjacent to the raster lines RL112 of the previous second pass, upstream (left in FIGS. 9A to 9F) in the transport direction, in the first division region DA1. Further, raster lines RL222 of the second pass are printed with color ink over the raster lines RL112 (base image (white)) of the previous second pass, in the second division region DA2.

When the printing of the second pass is finished, the sheet is transported by the main scanning sending amount Δx (S5). Further, since it does not reach to the M-th pass in the second pass (J=2) (J=M) (negative determination in S6), the recording unit 30 is moved to the next pass position for sub-scanning (S7). Further, the J value is increased to be J=3 (S8) and then the process proceeds to step S4.

Further, printing of the third pass is performed (S4). In the third pass, as shown in FIG. 9C, raster lines RL213 of the third pass are printed with white ink, adjacent to the raster lines RL113 of the previous third pass, upstream (left in FIGS. 9A to 9F) in the transport direction, in the first division region DA1. Further, raster lines RL223 of the third pass are printed with color ink over the raster lines RL113 (base image (white)) of the previous third pass, in the second division region DA2.

When printing of the third pass is finished, the sheet is transported by the main scanning sending amount Δx (S5) while the recording unit 30 is moved to the next pass position for sub-scanning (S6).

Further, printing of the fourth pass (the eight pass from the first) is performed (S4). In the fourth pass, as shown in FIG. 9D, raster lines RL214 of the fourth pass are printed with white ink, adjacent to the raster lines RL114 of the previous fourth pass, upstream (left in FIGS. 9A to 9F) in the transport direction, in the first division region DA1. Further, raster lines RL224 of the fourth pass are printed with color ink over the raster lines RL114 (base image (white)) of the previous fourth pass, in the second division region DA2.

Further, when the printing of the fourth pass is finished, the sheet is transported by the main scanning sending amount Δx (S5). Therefore, the sheet 13 and the print area PA are arranged in the positional relationship of FIG. 9E. Further, since it is determined that it reaches the M-th pass (J=M) (J=4 in the embodiment) (positive determination in step S6), the recording unit 30 is returned to the position for the first pass (S9). Further, J is returned to 1 (S10).

Further, it is determined whether the number K of times of lateral scanning reaches the same value as the plate number N (N=2 in the example of FIGS. 8A to 9F) (K=N). Since K is equal to N (K=2), whether printing is finished is determined in step S13. When printing is not finished (negative determination in S13), the process returns to step S4. For example, when the main control unit 71 determines that the count number of the number of printed pages does not reach the designated number of pages, the process returns to step S4.

When the second lateral scanning is finished, the third lateral scanning is performed. In the third lateral scanning, raster lines of the passes are shifted by ΔL/M for each pass and newly printed with white ink while raster lines of the main image are printed with color ink over the previous (second) raster lines of the base image (white).

Accordingly, a new base image is printed with white ink in the first division region DA1 by the present printing while a main image is printed over the base image printed in the previous time, in the second division region DA2. Further, when printing of the designated pages is finished by continuously performing the processes (positive determination in S13), printing is finished.

In the example of double-plate printing, consideration the base image, the first lateral scanning corresponds to the first recording process and the second and the following lateral scanning corresponds to the second recording process. Further, considering the main image, the second lateral scanning corresponds to the first recording process and the third and the following lateral scanning correspond to the second recording process. Further, in the example of double-plate printing, in the N-th (N=2 in the example) and the following lateral scanning, the previous lateral scanning, which prints the first plate image and the i+1-th plate image (i=1 to N−1) in the N (two) division regions corresponds to the first recording process and the present lateral scanning, which prints the first plate image and the i+1-th plate image (i=1 to N−1) over the i-th plate image recorded in the previous lateral scanning, in the N division regions corresponds to the second recording process.

In triple-plate printing, as shown in FIG. 10A and FIG. 11, the base image P1 of the first plate is printed in the first lateral scanning. Further, as shown in FIG. 10B and FIG. 11, in the second lateral scanning, the base image P1 of the first plate is printed adjacent to the previous base image P1, upstream in the transport direction while the main image P2 of the second plate is printed over the previous base image P1. Further, as shown in FIG. 10C and FIG. 11, in the third lateral scanning, the base image P1 of the first plate is printed adjacent to the previous base image P1, upstream in the transport direction while the main image P2 of the second plate is printed over the previous base image P1 and the overcoat image P3 of the third plate is printed over the previous main image P2. Thereafter, after the fourth lateral scanning, the print area PA is positioned downstream in the transport direction as much as one division region with respect to the previous position of the sheet 13, and, similar to the third time, a new base image P1 is printed, a main image P2 is printed over the previous base image P1, and an overcoat image P3 is printed over the previous main image P2, sequentially from the upstream side of the sheet 12 (the first division region DA1).

In the example of triple-plate printing, consideration the base image, the first lateral scanning corresponds to the first recording process and the second and the following lateral scanning corresponds to the second recording process. Further, considering the main image, the second lateral scanning corresponds to the first recording process and the third and the following lateral scanning correspond to the second recording process. Further, considering the overcoat image, the third lateral scanning corresponds to the first recording process and the fourth and the following lateral scanning correspond to the second recording process. Further, in the example of triple-plate printing, in the N-th (N=3 in the example) and the following lateral scanning, the previous lateral scanning, which prints the first plate image and the i+1-th plate image (i=1 to N−1) in the N (three) division regions corresponds to the first recording process and the present lateral scanning, which prints the first plate image and the i+1−th plate image (i=1 to N−1) over the i-th plate image recorded in the previous lateral scanning, in the N division regions corresponds to the second recording process.

As described above, according to the printing method, in double-plate printing, the same standby time (drying time) as the necessary time for one lateral scanning is ensured from printing of the previous base image to printing of the present main image over the base image. As a result, the ink of the main image printed over the base image is difficult to permeate. Further, in triple-plate printing, the same standby time (drying time) as the necessary time for one lateral scanning is ensured from printing of the previous base image to printing of the present main image over the base image, and from printing of the previous main image to printing of the present overcoat image over the previous main image. As a result, the ink of the main image printed over the base image is difficult to permeate and the ink of the main image is difficult to permeate when the overcoat image is printed over the main image.

As described above, according to the embodiment, it is possible to achieve the following effects.

(1) The microweave printing that prints present raster lines RL to fill the line spaces of the previous raster lines RL is performed, and printing of the first plate to the N-th plate is sequentially performed from the upstream side in the transport direction in the division regions while the sheet is transported by the main scanning sending amount ΔL/M that is 1/M of one division region. Therefore, the line spaces of the raster lines RL printed by adjacent nozzles in a pass are filled with the raster lines RL printed in the next and the following passes, such that it is possible to suppress banding that extends in the main scanning direction and the row recording regions for each pass are deviated by ΔL/M in the main scanning direction x, and accordingly, it is possible to suppress banding that extends in the sub-scanning direction.

(2) Since the main image is printed by the present lateral scanning, over the image printed in the previous lateral scanning, it is possible to ensure a standby time (drying time) corresponding to the necessary time for one lateral scanning between printing of the image of the lower layer and printing of the image of the upper image. Therefore, it is possible to print the image of the upper layer during the standby time, because the ink of the image of the lower layer proceeds to be dried. As a result, the ink of the image of the upper layer does not permeate, such that it is possible to increase the print quality. For example, for double-plate printing, it is possible to suppress permeation of ink when the main image is printed over the base image. Further, for triple-plate printing, it is also possible to suppress permeation of ink of the main image when an overcoat image is printed over the main image. Therefore, it is possible to provide a product (printed matter) with high print quality.

(3) Since N is 3, an image of three plates of a basic printing, main printing, and overcoat printing can be printed with high quality, with small banding in both main scanning direction X and sub-scanning direction.

(4) In one pass, since the raster lines RL of the images of the first plate to the N-th plate are printed in the division regions DA1 to DAN acquired by dividing the print area PA into N in the main scanning direction X, it is possible to perform print without waste and it is not necessary to provide a stopping time for drying the ink between the previous and present lateral scanning. Therefore, it is possible to efficiently produce (print) a product with high print quality.

(5) The drying time T1 (time interval) from printing of the plate image of the lower layer to printing of the plate image of the upper layer equal to or more of the set time $T_0$ for drying the lower layer ink is ensured. Therefore, it is possible to effectively avoid permeation of ink in a printed matter, such as a label, printed on the sheet 13.

(6) When it is determined that the necessary time (that is, drying time) of one lateral scanning which is equal to or more of the set time $T_0$ is not ensured, the necessary time for one lateral scanning is made equal to or more of the set time $T_0$ by reducing the main scanning speed and the sub-scanning speed or increasing the stop standby time between passes or lateral scanning. Therefore, it is possible to efficiently perform printing with high quality, without being influenced by difficulty in drying ink, even though printing of a plurality of plates is performed by using ink that is relatively difficult to dry.

(7) In particular, it is easy to avoid permeation in the image, even through aqueous resin ink that is difficult to dry or cure relatively to ECO-SOL ink or UV ink.

The embodiment described above may be modified into the following ways.

In multi-plate printing, a determining unit that determines whether the standby time for drying the image of the lower layer which is performed by the previous printing is necessary may be provided. When it is determined that the standby time for drying is necessary by the determining unit, the control unit ensures the necessary standby time by reducing the movement speed of the recording unit 30 (at least one of the main scanning speed and the sub-scanning speed) or delaying the start of relative movement of the present recording unit 30. Further, the step in which the determination of the determining unit is performed corresponds to a determining step. Therefore, a necessary drying time is ensured between the previous printing and the present printing. Accordingly, the present printing is performed over the previous printing after the portion where the previous printing is performed is dried by a necessary amount, such that permeation of ink due to the present printing is not easily generated.

Although it is shifted by Δx (=ΔL/M) in the main scanning direction for each pass, the main scanning sending amount Δx by be changed by the pass. In this case, since the gaps of the boundaries of the row recording regions in the main scanning direction is not uniform, it is possible to make the generation of banding, which extends in the sub-scanning direction, difficult.

The division regions are not limited to equal division of N. It is possible to make the generation of banding, which extends in the sub-scanning direction, difficult, even if the range widths of the division regions are not uniform.

Although the invention is applied to a lateral scan type printer, it may be applied to a serial printer. For example, when recording is performed in an interlaced recording method in a serial printer, for example, the nozzles that are used are switched while the recording head is moved in the main scanning direction and dot lines of row recording regions at different positions are formed in the main scanning direction and the sub-scanning direction. Further, dot lines are recorded in row recording regions adjacent in the same line as the row recording regions in the previous main scanning, in the next main scanning. For example, the recording head is equipped with a spare nozzle upstream in the sub-scanning direction, and when the first pass does not use the spare nozzle and the second and the following passes use the spare nozzle, it is possible to recording dot lines in the row recording regions adjacent to each other in the row recording regions of the previous pass, even if a sheet (paper) is transported for each pass. Even in the serial printer, it is possible to make difficult the generation of banding that extends in the main scanning direction and banding that extends in the sub-scanning direction. Further, it is possible to employ a configuration that positions a plurality of row recording regions to deviate in the main scanning direction and the sub-scanning direction by changing into the method by switching nozzles that are used and intermittently performing transporting of the recording medium in the sub-scanning direction during one main scanning.

When multi-plate printing is performed in a serial printer, it may be possible to dispose, sequentially from the upstream side in the transport direction, a first recording head (recording head for the first plate) which ejects white ink, a second recording head (recording head for the second plate) which ejects color ink, and a third recording head (recording head for the third plate) that ejects ink for an overcoat. That is, a lower layer is printed and then an upper layer is printed over the lower layer at the downstream side in the transport direction by disposing recording heads only for plates upstream in the transport direction to print plate images of the lower layer. For example, when N-plate printing is performed, recording heads only for N plates are sequentially disposed from the first recording head for the first plate to the N-th recording head for the N-th plate in the transport direction.

Although the first pass of the first lateral scanning and the first pass of the second lateral scanning are printed by using the same nozzle when dot lines of the same row of the same plate (for example, the first plate) in the embodiment, it may be possible to print the first pass of the first lateral scanning and the first pass of the second lateral scanning by using different nozzles. According to this configuration, it becomes easier to reduce banding.

Since the images of the print plates for basic printing and overcoat printing are not necessary to be printed with high resolution, the printing may be finished by Q passes smaller than M passes (Q=M/2R and R is a natural number) with large dots. According to this configuration, it is not necessary to print a base image and an overcoat image in some passes of the whole passes that print a main image. For example, it is possible to limit the movement range of one pass to a predetermined range for printing a main image or at least retain the number of passes of the first and final lateral scanning within Q passes. As a result, it is possible to improve printing efficiency.

It is not necessary to use the interlaced recording method in a lateral scan type printer or a serial printer. For example, a first recording process that records dot lines in a plurality of row recording regions set with a deviation in the main scanning direction and the sub-scanning direction and a second recording process that records dot liens in row recording regions adjacent each other in the same row as the previous row recording regions set in the first recording process are performed by using some or all of nozzles in a nozzle line, and then repeating the second recording process, with the row recording regions set in the previous second recording process as the previous row recording regions. It is possible to make the generation of banding, which extends in the sub-scanning direction, difficult, even if recording is performed by a recording method, other than the interlaced recording method, by using some or all of nozzles in a nozzle line. For example, even if a plurality of plates are printed to overlap each other by band printing, it is possible to increase the time interval from printing of the plate of the lower layer to printing the plate of the upper layer over the lower layer, and when recording is performed on division regions acquired by dividing a recording medium in the main scanning direction, the boundary of the previous and the present recording causes banding that extends in the sub-scanning direction, but the boundary is deviated in the main scanning direction at least for each band row, such that it is possible to make the banding, which extends in the sub-scanning direction, invisible.

The plate number is not limited to plural. Only one plate may be printed. According to the recording method of the invention, even if only one plate is printed, it is possible to reduce both of banding that extends in the main scanning direction and banding that extends in the sub-scanning direction.

Multi-plate printing is not limited to double-plate printing or triple-plate printing. For example, printing of four-plate printing or more may be possible.

The same image may be repeatedly printed two times by at least two plates in a plurality of plates.

The ink used for double-plate printing may be a combination of white and color or a combination of color and overcoat ink. Further, a combination of ink for white and overcoat may be possible. That is, any combination of white, color, and overcoat ink may be possible.

The recording section may be replaced by a recording unit equipped with a plurality of recording heads or may be one recording head.

Although the functional units of the controller in FIGS. 3 and 6 are implemented mainly by cooperation of software and hardware by the CPU and the ASIC, which execute programs, they may be implemented by software or hardware.

Although the ink jet type printer 11 is employed as the printing apparatus in the embodiment, a liquid ejecting apparatus that ejects or discharges liquid other than ink may be employed. Further, the invention may be used for various liquid ejecting apparatus equipped with a liquid ejection head discharging a small amount of liquid droplets. In this case, the droplets means the state of liquid discharged from the liquid ejecting apparatus, including a particle shape, a tear shape, a string shape with a tail. Further, the liquid may be a material that the liquid ejecting apparatus can eject. For example, the material may be in a liquid state, including liquid with high or low viscosity, a fluid substance, such as sol, gel water, other inorganic solvent, organic solvent, solution, liquid-state resin, liquid metal (metallic melt), including not only liquid as one state of the material, but a substance where particles of a functional material made of solid materials, such as colorant or metal particles are solved, dispersed, or mixed in a solvent. Further, the ink or the liquid crystal described in the embodiment may be a typical example of the liquid. The ink includes various liquid compounds, such as common aqueous ink, oil-based ink, gel ink, and hot-melt ink. A liquid ejecting apparatus that ejects liquid containing diffused or dissolved electrode material or color material, which are used for manufacturing, for example, a liquid crystal display, an EL (electroluminescence) display, a surface-emitting display, and a color filter, may be exemplified as a detailed example of the liquid ejecting apparatus. Further, a liquid ejecting apparatus that sprays a bio-organic material used for manufacturing a biochip, a liquid ejecting apparatus that ejects liquid that is a sample used as a precise pipette, and a printing apparatus, or a microdispenser may be possible. Further, a liquid ejecting apparatus that ejects a lubricant with a pin point to a precise machine, such as a watch or a camera, a liquid ejecting apparatus that sprays transparent resin liquid, such as ultraviolet-curable resin, on to a substrate in order to form a small semispherical lens (optical lens) used for an optic communication element, and a liquid ejecting apparatus that ejects etching liquid, such as acid or alkali, in order to etch a substrate may be employed. Further, the present invention may be applied to any one of the liquid ejecting apparatuses. Further, the fluid may be powders, such as toner. Further, the fluid described herein does not include substances composed of only gases.

What is claimed is:

1. A recording apparatus comprising:

a recording unit that includes a nozzle line having a plurality of nozzles and performs recording on a recording medium by ejecting liquid from the nozzle while moving in a first direction crossing the direction of the nozzle line;

a relative moving unit that relatively moves the recording unit and the recording medium in a second direction crossing the first direction; and a control unit that controls the recording unit and the relative moving unit, wherein the control unit controls the recording unit and the relative moving unit to perform:

a first recording process that records a plurality of dot lines in which dots are aligned in a row direction that is parallel with a main scanning direction by ejecting liquid from the nozzles while the recording unit is moved and sub-scanning that relatively moves the recording unit and the recording medium in the second direction, the plurality of dot lines forming a plurality of row recording regions that are set at positions deviated from each other in both the main scanning direction and a sub-scanning direction transverse to the main scanning direction;

a second recording process that records another dot line in a present row recording region that is adjacent, in the same line, to one of the plurality of row recording regions where the dot line is recorded in the first process by alternately performing the main scanning and the sub-scanning, and to repeat the second recording process, with the present mw recording region of the previous second recording process as the previous row recording region.

2. The recording apparatus of claim 1, wherein the control unit controls the recording unit and the relatively moving unit to move the recording unit and the relative movement unit a predetermined number of times in the main scanning direction and the sub-scanning direction to interlace the plurality of dot lines.

3. The recording apparatus of claim 1, wherein the control unit controls the recording unit and the relatively moving unit to return the recording unit to a first main scanning position every time the recording unit finishes M main scannings by alternately performing the main scanning and the sub-scanning while the recording medium is transported, in a transport direction that is in parallel with the first direction, as much as a length corresponding to 1/M of the maximum recording length of one main scanning, after the main scanning, and the control unit controls the recording unit to return to the first main scanning position every time the M main scannings is finished, by alternately performing the recording process and the scanning position changing process.

4. The recording apparatus of claim 1, wherein the fluid ejected by the recording unit includes aqueous resin.

* * * * *